US008342224B2

(12) United States Patent
Rountree

(10) Patent No.: US 8,342,224 B2
(45) Date of Patent: Jan. 1, 2013

(54) LOUVER SHADE ASSEMBLY

(76) Inventor: Roger R. Rountree, Ashville, SC (US)

( * ) Notice: Subject to any disclaimer, the term of this patent is extended or adjusted under 35 U.S.C. 154(b) by 0 days.

(21) Appl. No.: 13/065,756

(22) Filed: Mar. 29, 2011

(65) Prior Publication Data

US 2012/0097345 A1 Apr. 26, 2012

Related U.S. Application Data

(60) Provisional application No. 61/455,582, filed on Oct. 22, 2010.

(51) Int. Cl.
*E04F 10/00* (2006.01)

(52) U.S. Cl. ..... 160/77; 49/74.1

(58) Field of Classification Search ..... 160/76, 160/77, 81, 378, 379; 52/73–78; 49/74.1, 49/80.1, 81.1, 90.1, 89.1, 77.1, 79.1, 92.1
See application file for complete search history.

(56) References Cited

U.S. PATENT DOCUMENTS

| | | | | | |
|---|---|---|---|---|---|
| 21,417 | A | | 9/1856 | Herder | |
| 1,619,635 | A | * | 3/1927 | Rollins | 160/77 |
| 1,659,103 | A | * | 2/1928 | Hauser | 49/80.1 |
| 2,578,964 | A | * | 12/1951 | Bell | 160/81 |
| 2,805,711 | A | * | 9/1957 | Mehl | 160/76 |
| 2,865,589 | A | * | 12/1958 | D Azzo | 248/284.1 |
| 2,875,824 | A | * | 3/1959 | Rice | 160/58.1 |
| 3,134,426 | A | * | 5/1964 | Cherubin | 160/81 |
| 4,938,445 | A | | 7/1990 | Medley | |
| 5,560,147 | A | * | 10/1996 | Ashida et al. | 49/74.1 |
| 5,839,233 | A | * | 11/1998 | Smit | 52/198 |
| 5,873,202 | A | | 2/1999 | Parks | |
| 5,906,083 | A | | 5/1999 | Olsen et al. | |
| 6,061,962 | A | * | 5/2000 | Sosa | 49/249 |
| 6,363,664 | B1 | * | 4/2002 | Brutsaert | 52/74 |
| D605,281 | S | | 12/2009 | Kern | |
| 2009/0272037 | A1 | * | 11/2009 | Sosa | 49/74.1 |

* cited by examiner

*Primary Examiner* — Katherine W Mitchell
*Assistant Examiner* — Johnnie A Shablack
(74) *Attorney, Agent, or Firm* — Stephen R. Chapman

(57) ABSTRACT

An architectural louver shade assembly comprising a shade canopy mounted to a rotatable central axle tube that supports a rod rib assembly to which the shade canopy is attached by adjustable tensioners that mechanically stretch and tension the fabric element of the shade canopy to remove wrinkles and sags. A wax cylinder piston attached by elements of a wax piston pressure system that changes the pitch of the shade canopy in response to temperature with a gas spring unit that returns the shade canopy to its default, horizontal orientation with decreasing temperatures. An optional manual/mechanical system that, through use of control cables, changes the pitch of the shade canopy with a gas spring unit that returns it to a default orientation. A camber cable assembly that maintains an equal compression load on the rib arm units that directly support the shade canopy, and carrier brackets that support the central axle tube and connect the louver shade assembly to a building wall.

12 Claims, 32 Drawing Sheets

LOUVER SHADE ASSEMBLY

PRIORITY

This U.S. Patent Application claims priority of U.S. Provisional Patent Application 61/455,582 filed Oct. 22, 2010 which Provisional Patent Application is hereby incorporated in its entirety by reference.

FIELD OF THE INVENTION

This invention is a device that spans three disciplines, architecture, environmental control, and mechanical engineering. The louver shade assembly is a device that enhances the exterior appearance of a building while providing glare reduction and solar heat reduction to the interior; the invention involves design characteristics that enhance the exterior appearance and that utilize various configurations of gas compression springs and a combination of a gas compression spring and a wax piston assembly to passively or actively adjust shade canopy pitch in response to and to manage temperature and glare conditions. In addition, the invention includes fabric tensioners that can tension the shade cover fabric, thereby eliminating unsightly sagging and fostering drainage from the shade canopy and optimizing the design appearance of the shade canopy. The tensioners also allow the use of fabrics that otherwise would be too dimensionally unstable for conventional frame based awnings.

BACKGROUND OF THE INVENTION

The term louver (or louvre in European usages), at least in its current context traces to the French l'ouvert, the opening. This loose definition is appropriate for the original usages of louvers, reportedly sometime in the Middle Ages, from the fifth century to about AD 1350. Although the definition of louver is not precise, it conveys certain specific concepts: in its most archaic sense, a more-or-less open-sided structure to let out smoke, prevent rain from entering, and admit light. The definition contemplates a support structure with side pieces positioned vertically or horizontally, slats or veins, that allowed smoke to flow out, excluded rain, and permitted light to enter. In the modern context, the term louver is applied variably to the individual slats or veins, or to an entire structure, frame and slats. In the current application, louver shade assembly refers to the entire structure and shade canopy refers generally to what has been considered a slate or vein.

Initially, louvers were confined to structures on the exteriors of buildings. The use has expanded significantly to include functional elements of air circulation systems, and variations of louvers are included as part of interior decorating as witnessed by the wide array of Venetian blinds in homes as well as in businesses and in professional offices. These louvers (blinds) are used most frequently in the interior of homes to ensure privacy and reduce glare, as are most common window shades. They also constitute part of the decorative design of homes, businesses, and professional offices.

Exterior shade louvers have been demonstrated to be effective in providing shade, reducing solar heat gain, and promoting ventilation. Exterior louver systems may be groups of louver veins or slats positioned vertically along window ledges (or frames) or groups of veins or slats positioned horizontally from the side of a building and extending over windows from a position at or slightly above the uppermost window to be shaded. Spacing and the horizontal orientation (pitch) of the louver veins or slats is critical in determining the degree of shading and related cooling. The privacy function of louvers is a direct function of the overlap of the individual veins or slats, with consideration that close spacing may restrict air circulation while promoting privacy, thereby requiring certain design compromises Louvers find a variety of specialty uses, from systems that open and close in response to the activation of ventilation systems or to exhaust requirements, to flight control surfaces in the US Space Program.

Louvers and the use of louvers have been allowed subject matter of US patents for more than 150 years. U.S. Pat. No. 21,417A issued to Herder on Sep. 7, 1858 describes and claims a l'ouver system that functions as a "window blind" and is fitted with screening also to serve as an insect net. Far more recently, claims for a louver bracket assembly that extended the height of a louvered fence were allowed in U.S. Pat. No. 4,938,445 issued Jul. 3, 1996 to Travis D. Medley.

Louvers are currently used in a variety of settings to promote privacy and to reduce glare/provide shade thereby adding to individual comfort. U.S. Pat. No. 5,873,202 issued to Parks on Feb. 23, 1999 discloses a slidably adjustable awning in which louver veins or slats replace a solid, fabric awning on a frame; the angle of the slats or veins can be manually changed to increase/decrease desired level of shading.

In a similar application, Olsen, et al. in U.S. Pat. No. 5,906,083 issued May 25, 1999 disclose and claim a modular form of louvers that provide both the physical benefits of shading and cooling as well as representing/satisfying unique architectural design opportunities. Louvers have been allowed subject matter of design patents; see, for example D605,281, Louvers Vent, issued Dec. 1, 2009 to Ralf Kern.

In addition to applications in a wide array of structural settings, free standing as well as attached to buildings of all types, louvers find many other uses related to air flow and heat transfer regulation. See for example U.S. Pat. No. 7,614,682 to Major issued Nov. 10, 2009 for directing air flow in a HVAC system; U.S. Pat. No. 7,610,910 to Ahmed issued Nov. 3, 2009 for controlling building component air flow characteristics, or Long, U.S. Pat. No. 7,621,718 issued Nov. 24, 2009 disclosing application of louvers as air foils in gas turbine engines. These applications are well beyond the scope of the present application/invention in which a louver shade assembly is used to reduce glare and manage solar heat gain in a building, and in which the degree of shading is adjusted in a variety of ways.

SUMMARY OF THE INVENTION

The purposes and goals of the invention include:

first, a louver assembly with a tension mounted fabric element of the shade canopy wherein the fabric element is supported by a ridge tube and a first and a second fabric anchor extrusion;

second, a shade canopy support system in which rib arm units traverse a central axle tube and adjustable canopy tensioners attached to the ends of the short and long arms of the rib arm unit are connected to the fabric anchor extrusions, and further in which the tension on the fabric element of the shade canopy can be adjusted by the canopy tensioners;

third, a rib hub assembly including the rib hub that engages and clamps the rib arm units in position on the central axle tube, and further in which the rib hub assembly includes an adjustable camber cable guide unit adapted to equalize the compression load with respect to the rod rib assembly and a ridge tube cradle adapted to support the ridge tube that in turn supports the fabric element of the shade canopy;

fourth, a mounting bracket adapted to engage a carrier bracket assembly and anchor the carrier bracket and all parts of the invention to a building;

fifth, a carrier bracket assembly with a base flange plate adapted to engaging the mounting bracket and further having a support arm extending to the base flange plate, and an axle support ring connected to the end of the support arm;

sixth, positioning of the central axle tube in the lumen of axle support ring such that the central axle tube and connected hub arms rotate to change the pitch of the shade canopy either from or to its default orientation;

seventh, a compression gas spring connected to the mounting bracket and with the cylinder positioned in the lower body chamber of the mounting bracket and the piston connected to the rear fabric anchor extrusion by a connecting cable, so as to maintain the shade canopy in a horizontal, default orientation, or return it to such orientation from an alternative, pitched orientation;

eighth, a compression gas spring connected by the piston to the top of the mounting bracket and with the cylinder positioned and connected to the shade canopy so as to maintain the shade canopy in a default, downward pitch orientation;

ninth, a wax piston assembly with the cylinder connected to the mounting bracket and the piston connected to a support block that is pivotally connected to the first ends of a pair of lift arms the first ends of which are anchored to the support arm, and with a lift block pivotally connected to the second ends of the pair of lift arms and positioned to engage the second fabric anchor extrusion such that when the piston is forced outward from the cylinder in response to heating, the lift arms are rotated upward, the rear fabric anchor extrusion is lifted, and the shade canopy is rotated to a downward pitch orientation; a compression gas spring attached to the mounting bracket and positioned in the lower body chamber with the piston attached via a cord or cable to the rear fabric anchor extrusion functions to return the shade canopy to its default, horizontal orientation when the wax cylinder is cooled; and tenth, a system adapted actively to change both the elevation and pitch orientation of a shade canopy in which a dove-tail mounting plate is secured to a building and in which wedge guides extruded as part of the lower body chamber of the modified mounting bracket engage the dove-tail mounting plate, and wherein a connecting rod links the rear fabric anchor extrusion to the top of the dove-tail mounting plate and a pulley system is also secured to the dove-tail mounting plate; the first end of the lift cable is connected to the modified mounting bracket and the lift cable engages the pulley wheel and the second end of the lift cable extends downward from the modified mounting bracket; a downward pull on the lift cable pulls the modified mounting bracket upward in relation to the dove-tail mounting plate and because of the rigid link between the second fabric anchor extrusion and the top of the dove-tail mounting plate, the upward movement of the modified mounting bracket lifts the central axle tube and generates a relative downward force on the rear fabric anchor extrusion causing it to rotate to a horizontal pitch orientation; unless the pull cable is secured, the force of gravity will cause the shade canopy to return to its default, downward pitch orientation.

These and other goals and purposes are satisfied by a louver shade assembly comprising a louver assembly comprises in part a shade canopy, a central axle tube, rod rib assembly, and carrier bracket assembly; wherein the carrier bracket assembly consists in part of a mounting bracket and carrier unit comprising a base flange plate from which the support arm extends; the support arm terminates in the connector tongue to which the axle support ring is connected; the axle support ring engages and supports the central axle tube that traverses the lumen of the axle support ring and rotates within it; The rod rib assembly comprises the rib hub and rib arm unit (comprising the long arm and the short arm); the rib arm unit traverses a diameter line of the central axle tube; the rib hub is positioned on the central axle so as to engage and clamp the rib arm unit in position, traversing the central axle tube; a canopy tensioner is slideably connected to each end of the rib arm unit and also is connected to the corresponding fabric anchor extrusion; the camber cable passes through an adjustable camber cable guide on the rib hub and is adjustably connected to each canopy tensioner; the ridge tube extends the full length of the central axle tube, is supported by the ridge tube cradle formed on the rib hub, and supports the fabric element of the shade canopy; a compression gas spring is positioned in and connected to the mounting bracket and is connected by a cord to the rear fiber anchor extrusion, such that in its decompressed state, the compression gas spring holds the shade canopy in is default, horizontal orientation; alternatively, a compression gas spring is positioned at and connected to the top of the mounting bracket; the piston is attached to the rear fabric anchor extrusion; in its decompressed state, the compression gas spring pivots and holds the shade canopy in a default, increased (downward) pitch orientation; an alternative mode employs both a compression gas spring and a wax piston assembly; the wax piston assembly, in response to increasing temperature, generates the force to rotate the shade canopy from its default, horizontal orientation to an increased (downward) pitch orientation; the wax piston assembly cylinder anchor pin connects the cylinder to the mounting bracket; a threaded piston adjuster connects the cylinder piston to the piston support block that is pivotally connected to the proximal ends of a pair of lifting arms, and the proximal ends of the pair of lifting arms are attached to the support arm of the carrier unit; a lift arm block is pivotally connected to the distal end of the pair of lift arms, and the lift arm block engages the rear fabric anchor extrusion such that extension of the piston from the cylinder rotates the piston support block forcing the distal ends of the support arms upward; the lift arm block transfers this upward force to the rear fabric anchor extrusion causing it to rotate upward, thereby increasing the pitch of the shade canopy; reducing temperature does not reverse the action of the wax piston assembly; when temperatures are lowered, a compression gas spring positioned in the lower body of the modified mounting bracket as described above draws the rear fabric anchor extrusion downward, returning the shade canopy to its default, horizontal orientation; a manually deployed pitch/elevation assembly can change both the pitch orientation of the shade canopy and its elevation in relation to a window it is shading; a dove-tail mounting plate is anchored to the building structure, and a modified mounting bracket is connected to the dove-tail mounting plate by wedge guides extruded on the side walls of the lower body chamber of the modified mounting bracket; a lift cable is connected to the top of the modified mounting bracket and engages the wheel axle element that is attached to the dove-tail mounting plate, the top of the dove-tailed mounting plate is connected to the rear fabric anchor extrusion by a connecting rod; downward force on the lift cable raises the modified mounting bracket (and connected carrier unit) and pressure from the rigid connecting rod rotates the shade canopy and increases its pitch orientation and lifts the entire assembly along the dove-tail mounting plate; the shade canopy returns to its default, horizontal orientation in response to the force of gravity, unless the lift cable is secured in position

EXAMPLES

Louver Assembly

Figure 1A:
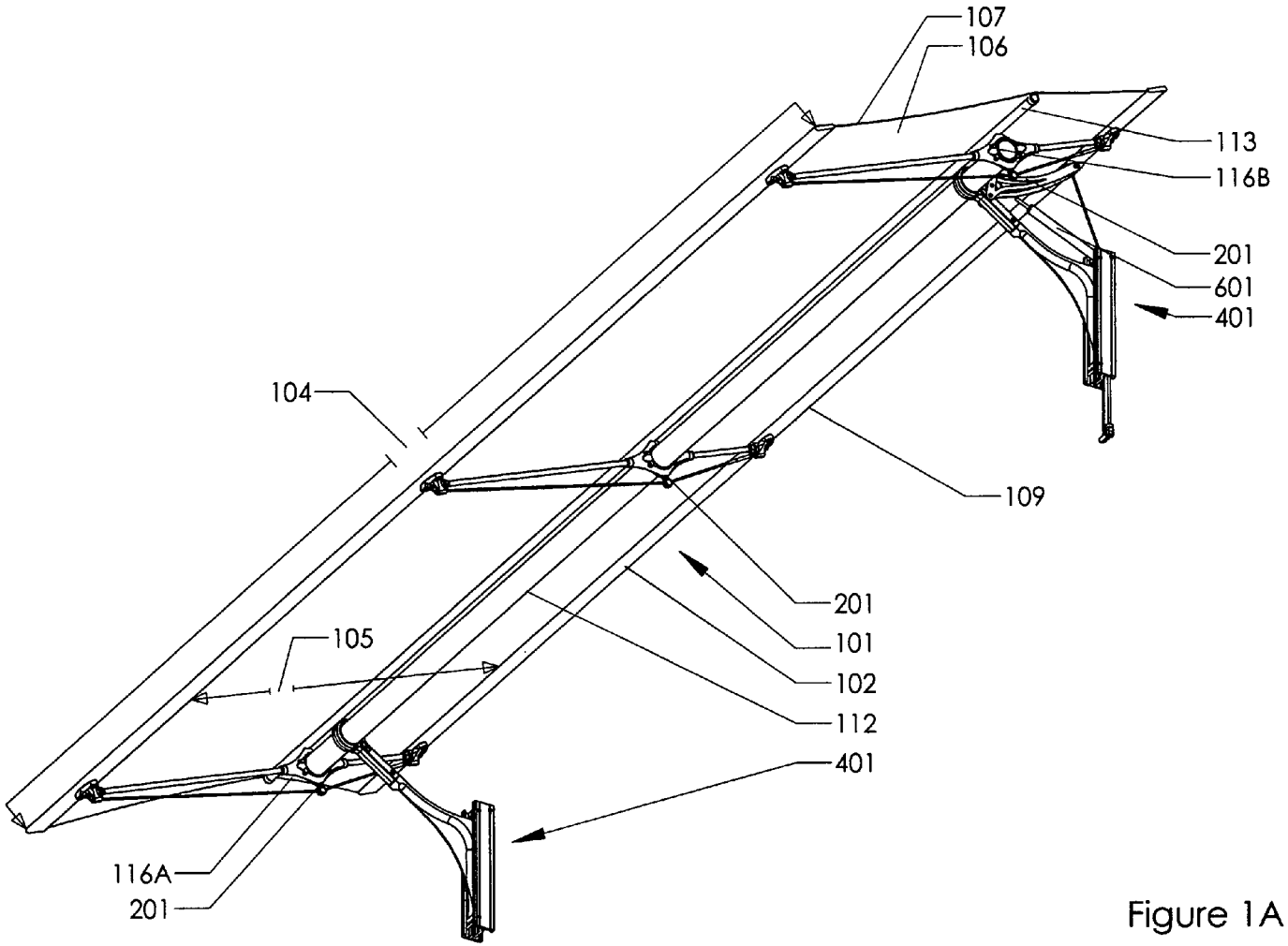
FIG. 1A provides an overview of the louver assembly indicating major parts shade component, central axle tube, rod rib assembly, and carrier bracket.
Figure 1B:
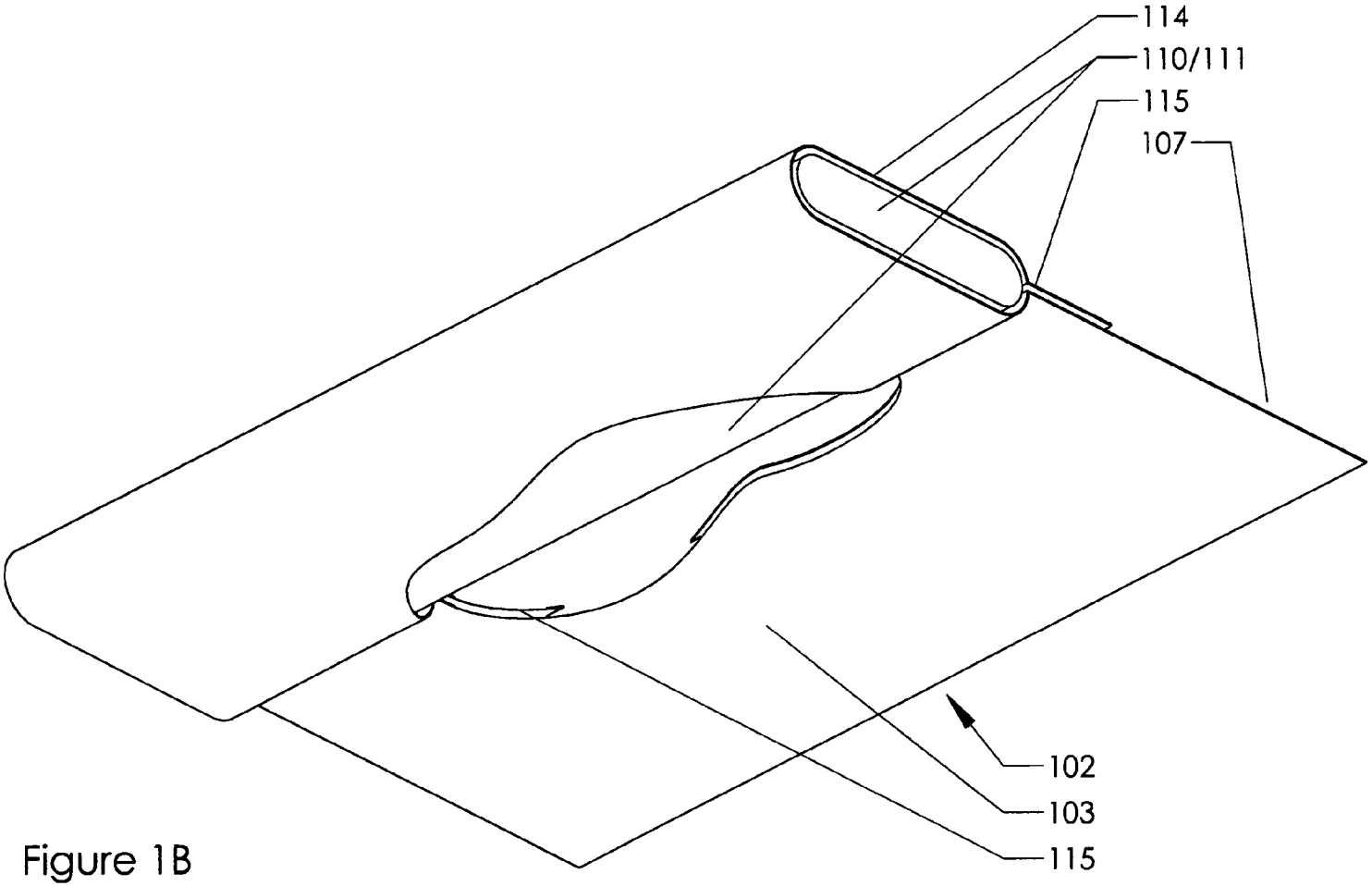
FIG. 1B provides details common to front and rear fabric anchor extrusions.

The louver assembly 101 comprises four major elements, components, and parts as illustrated in FIG. 1A and FIG. 1B. The louver assembly 101 comprises a shade canopy 102, a rotatable central axle tube 112, rod rib assembly 201.

The shade canopy 102 includes a fabric element 103 and the front 110 and rear 111 fabric anchor extrusions. The fabric element 103 is described as having a length 104 and a width (some times designated as depth) 105, as well as having a bottom surface 106 and a top surface 107. The fabric element 103 is also characterized by a front edge 108 and a back edge 109.

The fabric anchor extrusions provide the structural element for connecting the shade canopy 102 to the rod rib assembly 201 and further provide the connection surface for attachment of the pitch control devices (wax piston assembly, compression spring, and manual pull system) to the shade canopy. Aluminum fabric anchor extrusions are extruded into rectangular, commonly flattened, rectangular tube. Both of the fabric anchor extrusions, front 110 and rear 111, are equal in length to the length 104 of the fabric element 103. Although not an absolute limitation, maximum length rarely exceeds 24 to 30 feet (7.3 to 9.4 m).

The dimensions of the fabric anchor extrusion vary as a function of the length of the extrusion, the unit weight of the fabric from which the fabric element 103 is made, and potentially to specific environmental conditions to which the louver assembly may be exposed.

When the fabric anchor extrusion is extruded as a flattened tube, dimensions of the aluminum extrusion, by way of example. not limitation, are as follows: wall thickness 0.125 to 0.250 inch, height 0.25 to 0.50 inch, and width 1.5 to 4.0 inch (3.2 to 6.4 mm; 0.64 to 1.3 cm, and 3.8 to 10.2 cm, respectively). One skilled in the art recognizes that the material from which the fabric anchor extrusion is fabricated could be round, oval, or rectangular in cross-section and could be from a variety of metal, plastic, or composite materials, all of which are herein anticipated.

In one configuration, each fabric anchor extrusion 110 and 111 is positioned in a sleeve 114 formed respectively along the front edge 108 and back edge 109 of the fabric element 103, as illustrated in FIG. 1B. The sleeve 114 is formed by folding (or wrapping) the fabric around the fabric anchor extrusion, thereby forming a seam 115 along the length of the sleeve 114. The seam may be secured by various means known to those skilled in the art, heat or RF welding, stitching, or various adhesives, preferably, with man-made fabrics, joining the material along the seam line adjacent to the edge of the fabric anchor extrusion. Note, the width 105 of the fabric as illustrated and defined excludes the material required to form the sleeve and seam 114 and 115. In practice, this would be 6 inches (15 cm) or less.

The cross section shape (configuration) and means by which the fabric element 103 and fabric anchor extrusion are connected may assume a variety of forms, as one skilled in the art recognizes, including a specific form recognized as the keder anchor extrusion. Such variations do not alter the scope or intent of the invention and are anticipated by the appended claims.

By way of example, but not an absolute limitation, the width 105 of the fabric element 103 varies from 1 to 4 feet, preferably 2 to 3.5 feet (0.3 to 1.3 m, preferably 0.6 to 1.0 m), and the length 104 varies from 4 to 24 feet (1.1 to 8 m), or longer. The fabric element 103 is generally manufactured from various synthetic fibers, such as but not limited to, vinyl coated polyesters, and rarely may be manufactured from natural fibers (cotton). As one skilled in the art understands, the fabric may be dyed, woven, or otherwise decorated, and may be treated to display certain surface characteristics and to resist/withstand specific climatic conditions, such as excessive moisture, heat, and degeneration caused by ultra violet radiation.

Central Axle Tube and Rod Rib Assembly

Figure 2A:
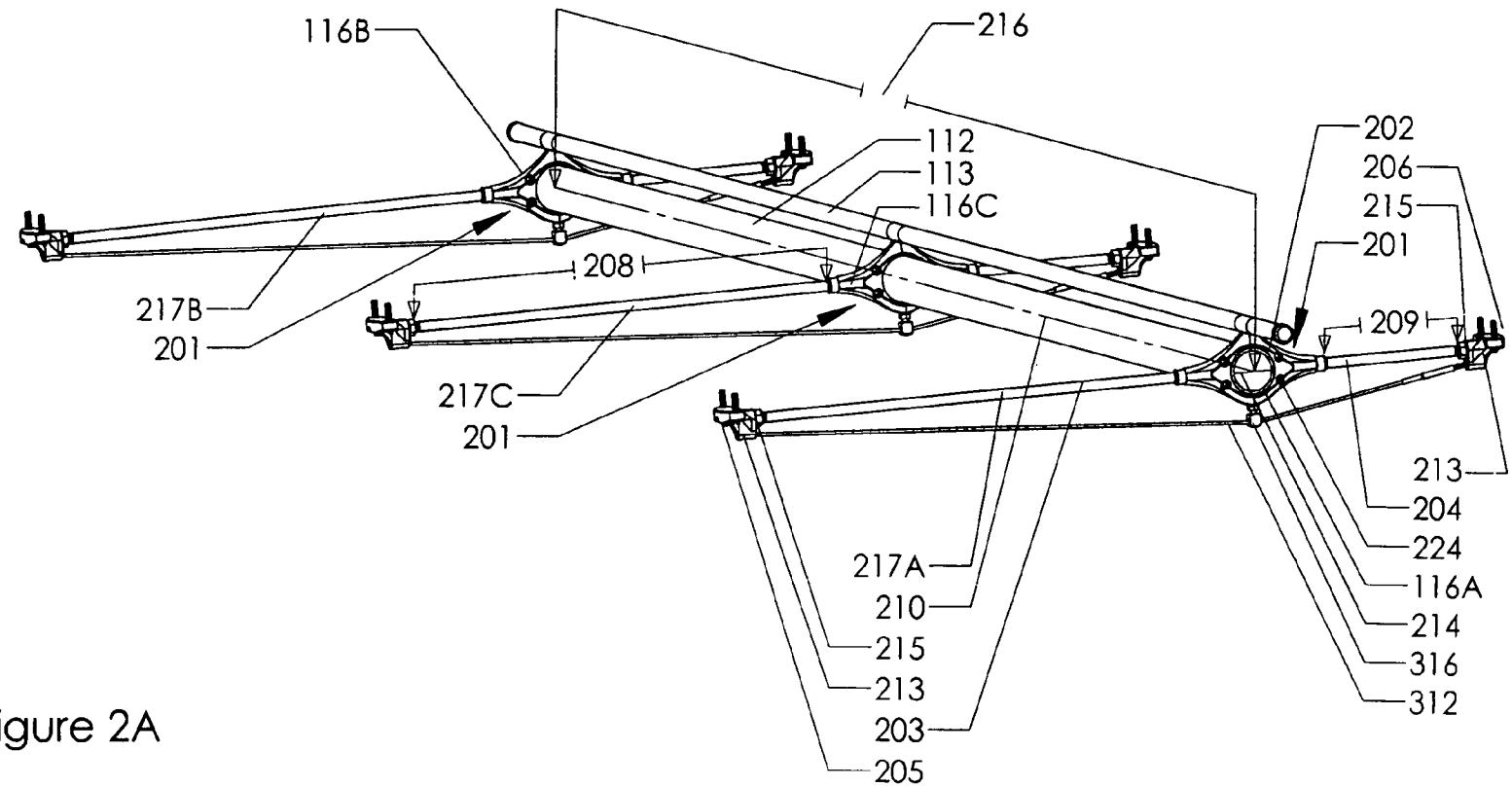
FIG. 2A illustrates rod rib assemblies positioned on central axle tube, camber cable, and ridge tube.

Although structurally separately identifiable, functionally, as illustrated in FIGS. 2A,B, and C, the rotatable central axle tube 112 and the rod rib assembly 201 constitute a functional element. The rotatable central axle tube 112 is the structural/functional backbone of the louver assembly 101, and is most commonly manufactured from 1.75 or 2 inch (4.5 or 5.0 cm) diameter, preferably anodized, aluminum tube. Such material is readily available through commercial aluminum suppliers. The overall length 216 of the rotatable central axle tube 112 varies as a direct function of the size (width) of the window, or group of windows to be protected (shaded) by the louver assembly 101. The length 216 of the rotatable central axle tube 112 is approximately 6 inches (15 cm) shorter than the length 104 fabric element 103 and the ridge tube 113. By way of example, not limitation, the length 104 of the fabric element 103 varies from 4 feet (1.2 m) to over 24 feet (7.3 m).

The rod rib assembly 201 comprises a rib arm unit 217 and the rib hub 202. The rib arm unit 217 is divided into a short arm section 204 and a long arm section 203.

One member of a minimum of one pair of rod rib assemblies 201 is positioned at the first end 116A of the rotatable central axle tube 112 and the second member is positioned at the second end 116B of the rotatable central axle tube 112. Depending on the overall length 216 of the rotatable central axle tube, additional rod rib assemblies may be spaced along the rotatable central axle tube. (See FIG. 2A.) For each rod rib assembly, the corresponding rib arm unit 217 traverses the rotatable central axle tube 112 along a common diameter line 124 such that when the rib arm units 217 are properly positioned they are parallel to each other and to any other arm positioned on the same rotatable central axle tube. They are in the same horizontal plane extending from the common diameter line 124 and extend on both sides of the central axle tube 112 at right angle to the longitudinal dimension 216 of the central axle.

Each arm rib unit 217 is positioned as a result of traversing the rotatable central axle tube 112 such that the rib arm unit 217 is divided into a long arm segment 203 and a short arm segment 204. The long arm segment 203 terminates in the distal end 205 of the rib arm unit 217, and the short arm segment 204 of the rib arm unit 217 terminates in the proximal end 206 of the rib arm unit 217. Equal segments of the distal 205 and proximal 206 ends of the rib arm units are threaded for a common length 215, varying from 2 to 6 inches (5 to 15 cm).

FIG. 2A provides an example in which three rib arm units 217A,B, and C are positioned at the first end 116A, the second end 116B, and at the mid-point of the central axle tube 116C. Rib arm units 217A and 217B are positioned flush at the first 116A and second 116B ends of the central axle tube 112. Rib arm units 217 are generally spaced 4 to 6 feet (1.2 to 1.8 m) apart. If the length 104 of the fabric element 103 is greater than 6 feet (2 m,) and up to approximately 12 feet (4 m), a third rib arm unit 127C (FIG. 2A) is positioned at the mid-point of the central axle tube, equi-distance from the first 217A and second 217B rib arm units. Thus, the distance is equal between any two, adjacent rib arm units 217A, 217B, and 217C, in this example, is 6 feet (2 m). If the overall length exceeds 12 feet (4 m), for example 24 feet (7.3 m), the third rib arm unit would be positioned at the mid-point 12 feet (3.7 m) from either end rib arm unit, and two additional rib arm units (not illustrated) would be positioned at a point equi-distance from the first end rib arm unit and the middle rib arm unit and equi-distance from the second end rib arm unit and the middle rib arm unit, a total of five rib arm units, each equi-distance from any immediately adjacent rib-arm unit (6 feet or 2 m) distances within the suggested range of 4 to 6 feet (1.2 to 2.0 m).

As illustrated in FIG. 2A, the rib arm units 217A, 217B, and 217C traverse the diameter of the rotatable central axle tube 112 and are positioned such that the length of the long arm 208 is twice (or more) the length of the short arm 209. This results in approximately 70 percent of the weight of the shade canopy 102 being positioned on the long arm side of the rotatable central axle tube 112. The relative proportion of weight distribution above 50 percent may be varied without altering the scope and intent of the invention, and such variation is anticipated by the invention.

The long 203 and short 204 arms of the rib arm unit 217 is fabricated preferably from stainless steel rod, varying in diameter, by way of example, not of limitation, from about 0.25 to 0.75 inch (0.63 to 1.9 cm). One skilled in the art recognizes that the long 203 and short 204 arms may be fabricated from a variety of other materials, including, but not limited to plastics and composites, and material may be square, round, or oval in cross-section with accommodation for threaded ends, and solid or hollow. Length of the long arm 208 and the short arm 209 varies with the specific width 105 of the shade canopy 102.

The rib hub 202 of each rod rib assembly 201 functions as a clamp to support the rib arm unit 217 when it is in position, traversing the central axle tube 112 and to engage and secure the central axle 112 in relation to the arm units 217. The rib hub 202 also supports the ridge tube 113. The ridge tube 113 is positioned in the in the ridge tube cradle 220 at the top edge 230A of the rib hub 202, and the ridge tube 113 extends the length 104 of the fabric element 103 parallel to the rotatable central axle tube 112. Functionally, the ridge tube supports the fabric element 103 of the canopy 102 and allows spacing for proper positioning of axle support ring element 501. The rib hub 202 of the rod rib assembly 201 may be manufactured in mirror image, half sections 225, and half sections are connected to form the rib hub 202.

Figure 2B:
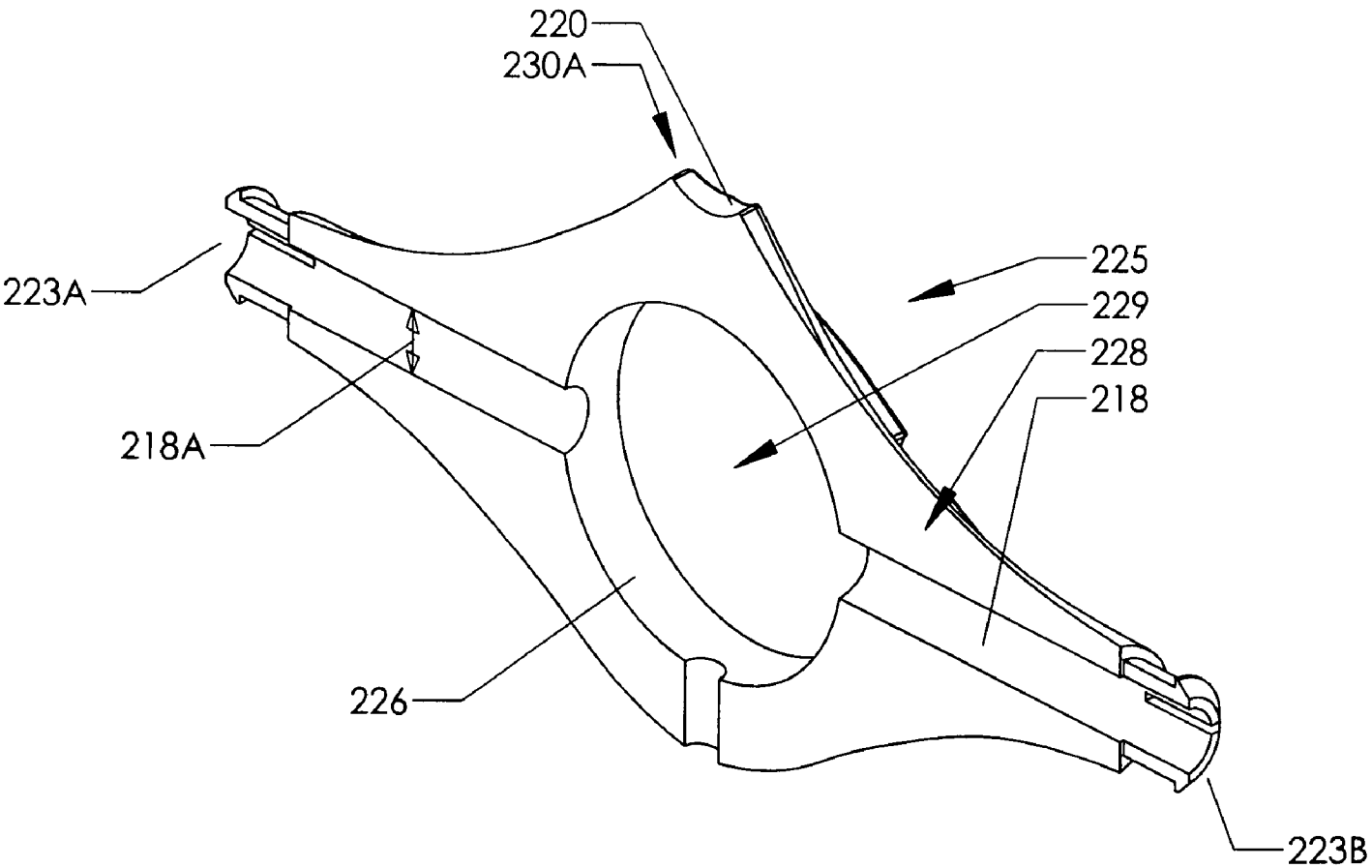
FIG. 2B provides half section, cut away view of a rib hub.

A half section 225 of the rib hub 202 as illustrated in FIG. 2B comprises the half body element 228. The half body element 228 includes a first end 223A and a second end 223B. The hub clamp chase 218 extends from the first end 223A to the second end 223B of the half body element 228. The diameter 218A of the hub clamp chase 218 is nominally equal to (slightly less than) the diameter of the stainless steel rib arm units 217.

The hub axle lumen 222 (FIG. 2C) traverses the center 229 of the rib hub 202 at a right angle to the arm unit 217. The hub axle lumen 222 is defined and limited by lumen walls 226. The ridge tube cradle 220 a semi-circular notch, adapted to receiving and positioning the 0.75 inch (1.9 cm) diameter ridge tube, is formed at the top center 230A of the rib hub 202.

The two half sections 225 of the rib hub are securely connected by bolts 224 traversing the two half units at four points to form the rib hub 202, clamp and secure the rib arm units 217 in position to ensure proper spacing of the long 203 and short 204 arms, and secure the rotatable central axle tube 112 in relation to the rib arm unit 217 and the ridge tube 113. The rib hub 202 engages the rotatable central axle tube 112, and the rotatable central axle tube 112 rotates within and is supported by the axle support ring 501 in response to force transmitted by either the piston pressure assembly 601 or the compression gas spring 701. The rod rib assembly 201 rotates with the rotatable central axle tube 112.

Figure 2C:
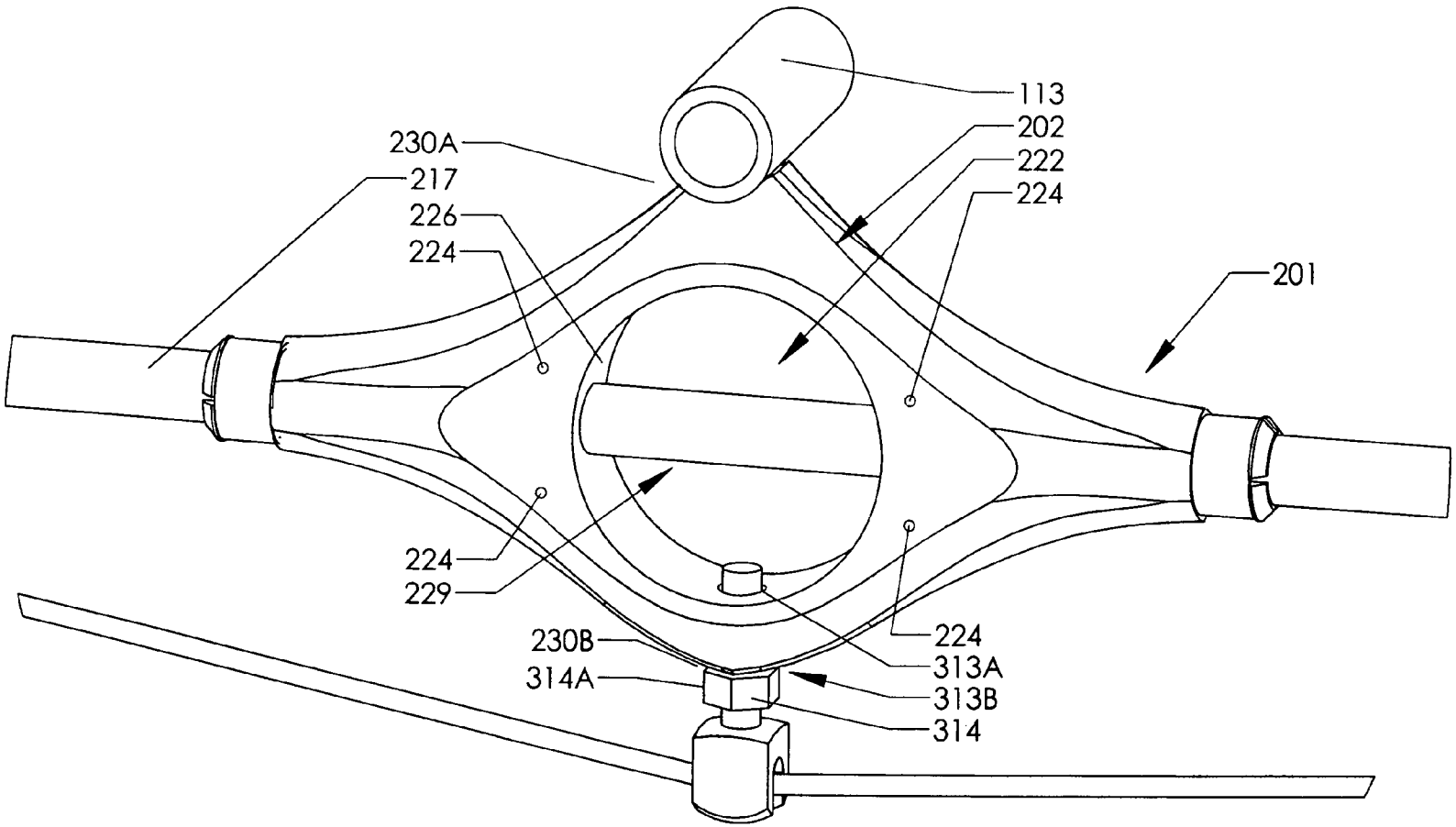
FIG. 2C illustrates rod rib assembly including rib arm unit camber cable, and cable guide.

FIG. 2C illustrates the rod rib assembly 201 with half sections 225 of the rib hub 202 connected by bolts 224 at four points. The rib arm unit 217 is positioned in the arm unit clamp chase 218, extending through the rib hub 202 from the first end 223A of the rib arm unit 217 to the second end 223B. The rotatable central axle tube 112 is positioned in the hub axle lumen 222, and is secured friction tight against the lumen walls 226. The ridge tube 113 is positioned in the ridge tube cradle 220 and extends at right angle to the rib unit 217 and parallel to the central axle tube 112.

Canopy Tensioner Unit

Figure 3A:
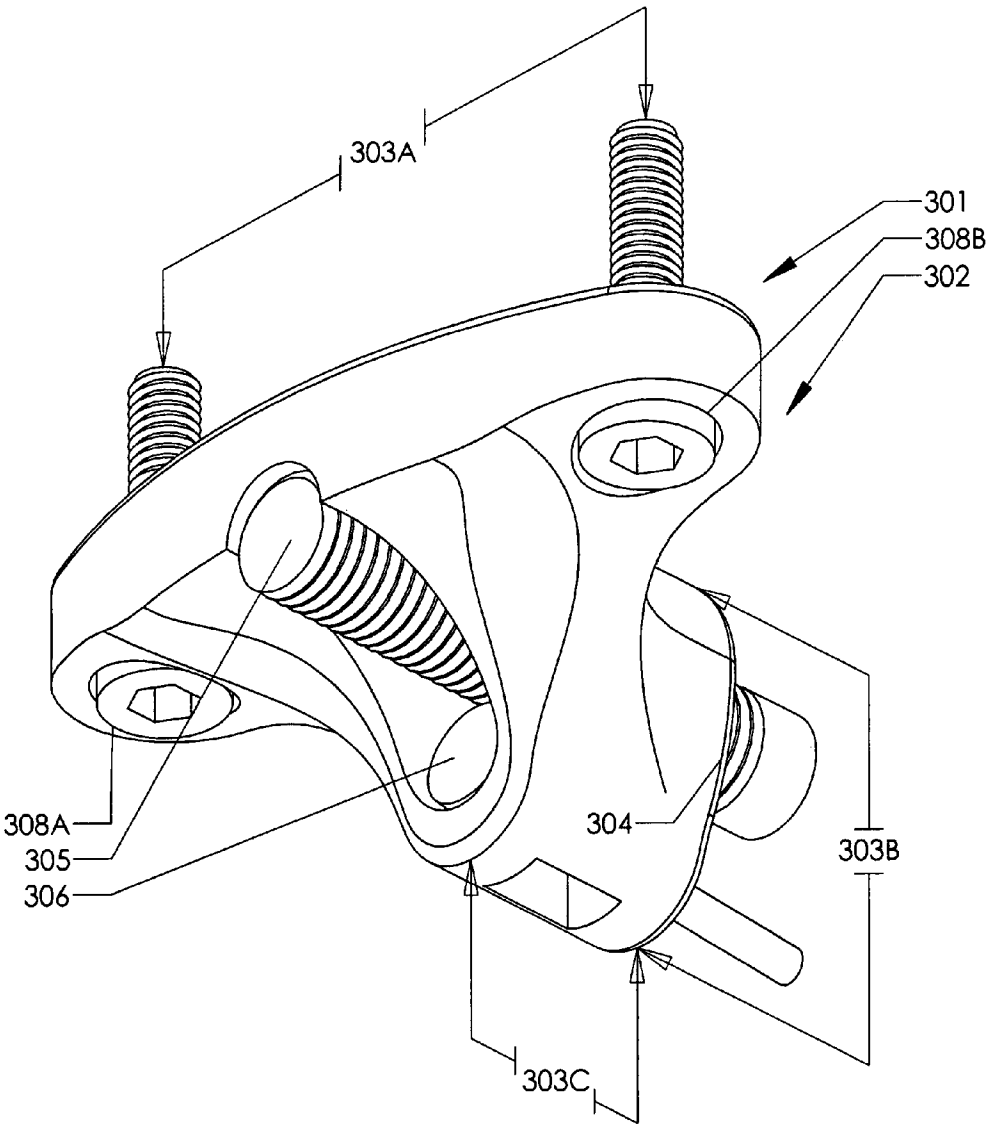
FIG. 3A illustrates canopy tensioner body.

As illustrated by FIGS. 3A,B,C, and D, a canopy tensioner 301 provides the basic structure for connecting the shade element 102 with the rib arm unit 217 and thus with the rod rib assembly 201. The basic structure of canopy tensioner 301 is illustrated in FIG. 3A. The canopy tensioner 301 comprises a tensioner body 302 with a width 303A, a height 303B, a length 303C; an arm connector chase 305 traverses the length 303B of the tensioner body 302, and a camber cable chase 306 also traverses the length 303B of the tensioner body 302 parallel to and below the support arm chase 305.

The arm connecting chase 305 is adapted to engage the threaded end 215 of long arm 203 or of the short arm 204 of the rib arm unit 217. Each tensioner is connected by bolts or similar means to a fabric anchor extrusion 110 or 111. Thus, each rod rib assembly is connected to the shade canopy by a pair of identical tensioners 301. One member of the pair of tensioners is secured to the front fabric anchor extrusion, and the second member of the pair of tensioners is anchored to the rear fabric anchor extrusion. Thus, the shade canopy 102 is physically connected to the rod rib assembly 201.

One skilled in the art recognizes that fabric anchor extrusions may assume may forms, including by way of specific example, but not limitation, the keder fabric anchor extrusion, and a canopy tensioner can be connected to any of these types of fabric anchor extrusion. Such variations are assumed by and included in the designation fabric anchor extrusion as used herein. As illustrated, the body 302 of the canopy tensioner 301 is connected to the front and rear fabric anchor extrusions 110 and 111 by a pair of bolts 308A and 308B with nuts. Other connector means could be used, including, but not limited to rivets and adhesive means and materials.

Figure 3B:
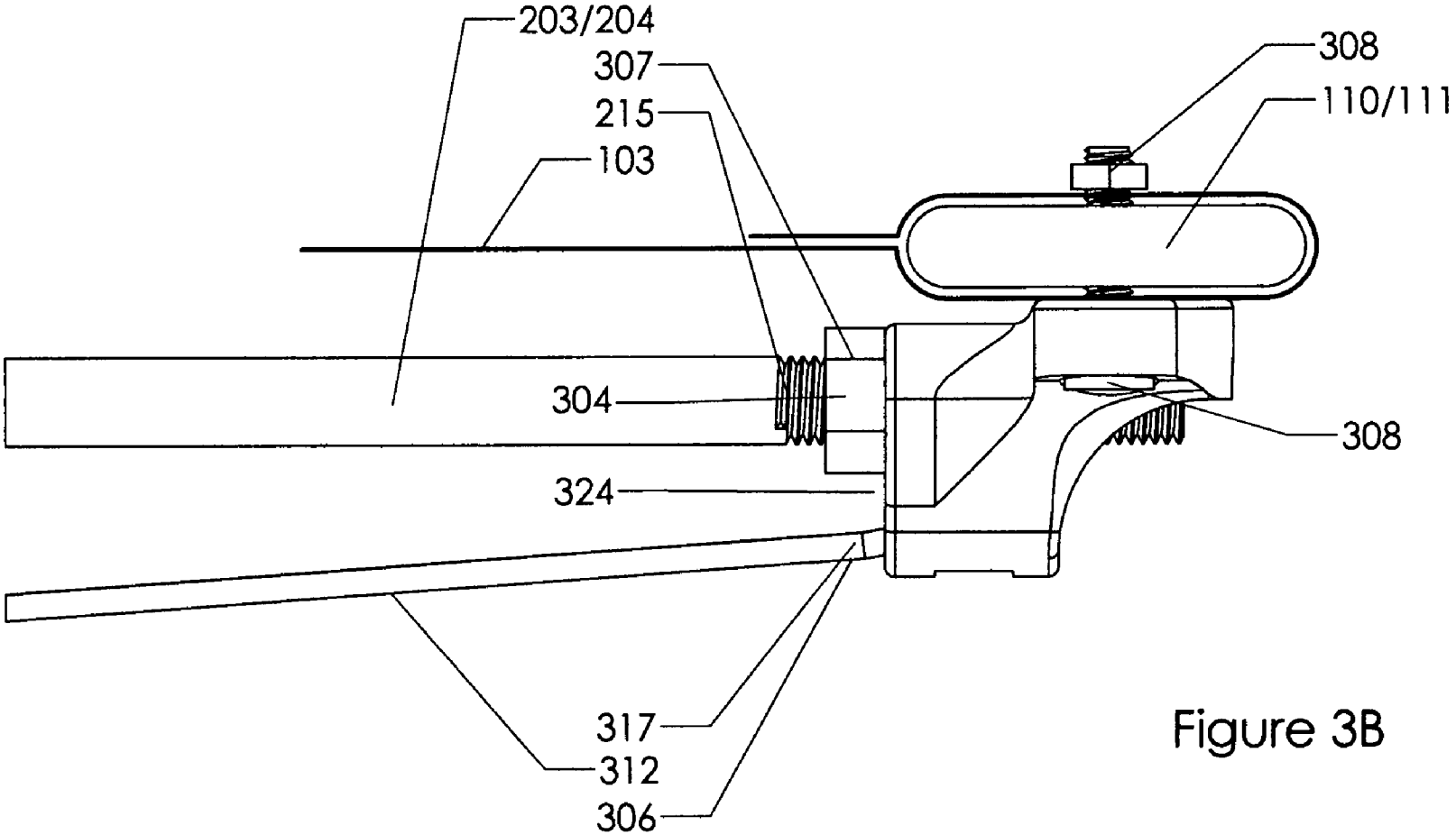
FIG. 3B illustrates canopy tensioner assembly positioned on a rib arm.

The threaded ends 215 of the long and short arms 203 and 204 respectively of the rib hub assembly 201 are positioned in the arm connector chase 305 and traverse the length 303C of the canopy tensioner body 302. A tension adjustment nut 307 is threaded on each arm 203 and 204 such that the tension adjustment nut 307 contacts the inner face 304 of the canopy tensioner body 302 such that rotating the nut increases tension on the front and rear fabric anchor extrusions 110 and 111, thereby stretching the fabric element 103 of the shade canopy 102. Rotating the tension nut clock-wise (as illustrated in FIG. 3B) causes the tension adjusting nut 307 to exert force on the canopy tensioner 301 moving it as appropriate towards the distal 205 or proximal 206 end. Movement is transferred to the front and rear fabric anchor extrusions, and as a result of such movement, tension is exerted on the fabric element. One of average skill in the art recognizes that reversing threading would reverse the direction of rotation of the tension nut required to generate the desired tension. Such modification is anticipated by the invention and does not alter the scope or intention of the invention.

Camber Cable Guide System

The camber cable guide system comprises at least two camber cable guide units 316, and in practice, the number of camber cable guide units generally equals the number of rib arm units 217 with one camber cable guide unit 316 connected to each rib arm unit 217. As illustrated in FIG. 2C, each camber cable guide unit 316 comprises a camber cable 312, a camber cable guide 313, and the camber cable guide 313 comprises a head 318 with an eye 319 and a threaded neck element 313A, and a camber cable guide chase 315 at the bottom center 230B of the rib hub 202. The camber cable guide 313 is positioned and pressed and held frictionally tight in the camber cable guide chase 315.

As illustrated in FIG. 2A and FIG. 2B, a camber cable 312 extends the full length of each rib arm unit 217A,B, and C, the length of which effectively equals the width 105 of the fabric element 103 as illustrated in FIG. 2A. The camber cable may be fabricated from woven wire (a wire subject to minimum stretching) or from a thin metal rod, such as a 0.25 inch (0.63 cm) stainless steel rod), by way of example, but not limitation.

Figure 3C:
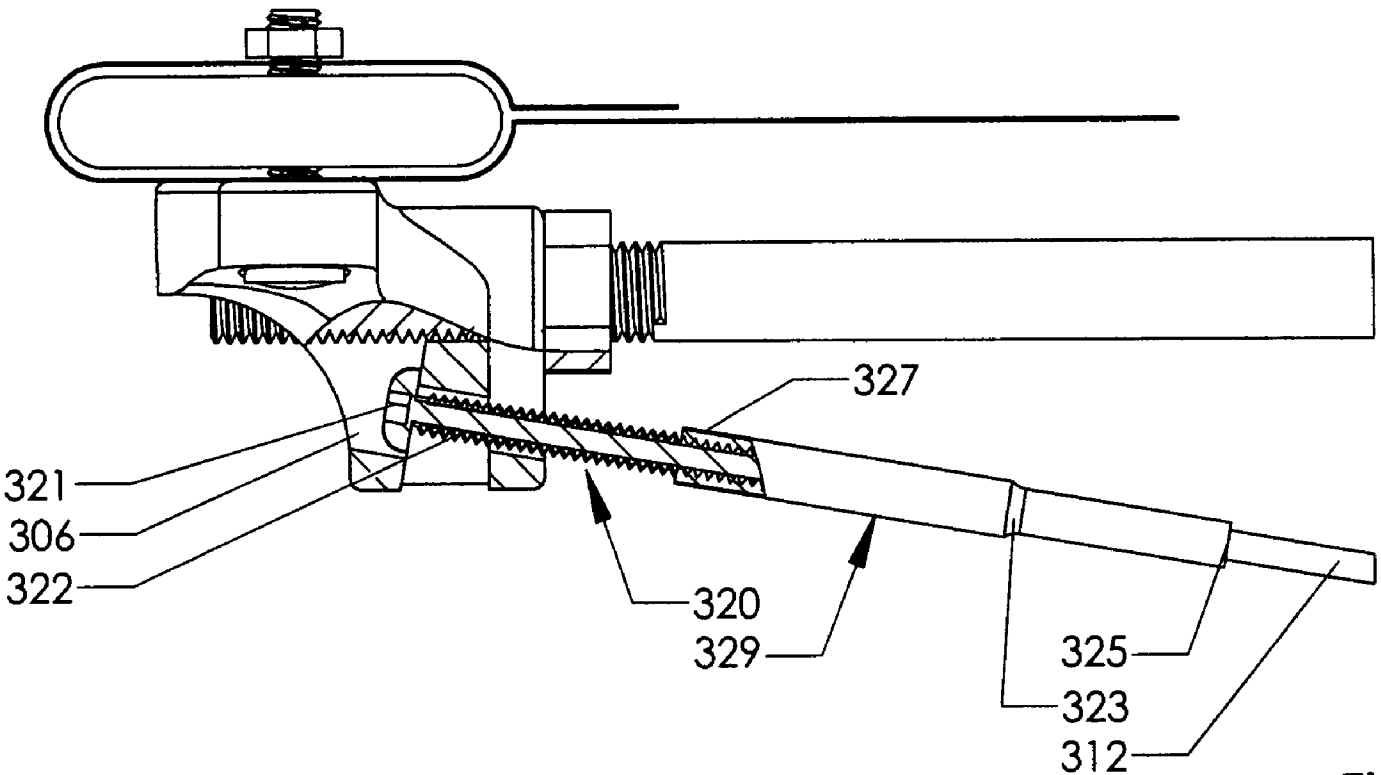
FIG. 3C illustrates canopy tensioner with the camber cable attached by an integrated turnbuckle device.
Figure 3D:
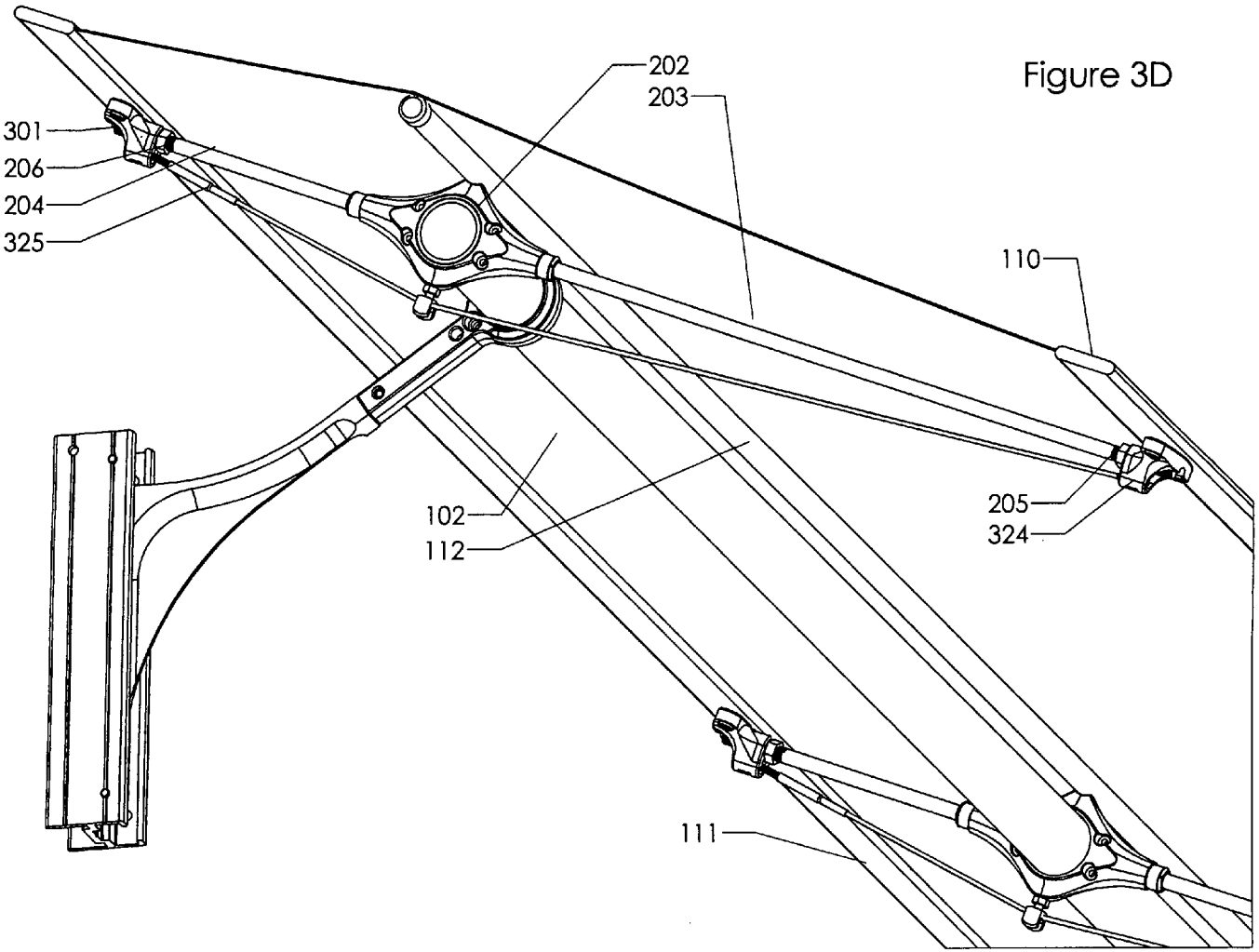
FIG. 3D provides bottom view of shade canopy showing central axle tube, rod tip assembly positioning, and canopy tensioners.

Tension on the arms 203 and 204 of the rod rib assembly 201 can be adjusted by the camber cable guide system 316 as illustrated in FIG. 2A and further explained in FIG. 2C, FIG. 3B, and FIG. 3D.

Each end of the camber cable 312 is secured to a canopy tensioner 301 directly, as illustrated in FIG. 3B or indirectly as illustrated by FIG. 3C by a turnbuckle cable attachment device 320. The camber cable 312 is passed through the eye 319 in the head 318 of camber cable guide 313. A nut 314 engages the threaded neck element 313A, and the distal segment 313B of the threaded neck element is positioned in the camber cable guide chase 315. The first face 314A of the nut 314 contacts the bottom surface 230B of the rib hub 202, and rotating the nut 314 extends (or retracts) the distal segment 313B of the camber cable guide 313, thereby changing tension on the long and short arms 203 and 204 to the ends of which the canopy tensioners are attached and anchored by attachment respectively to the front 110 and rear 111 fabric anchor extrusions.

The first end 324 of the camber cable 312 is secured directly to the camber cable anchor point 317 of the camber cable chase 306 of a canopy tensioner 301 positioned on the front fabric anchor extrusion 110, as shown in FIGS. 3B and 3D. As illustrated in FIG. 3C, optionally, the second end 325 of the camber cable 312 may be connected indirectly to the camber cable chase 306 of the canopy tensioner 301 attached to the rear fabric anchor extrusion 111. An integrated turnbuckle cable connector device 320 is secured to the camber cable chase 306 positioned on the rear fabric anchor extrusion 111; a terminal stay 321 on the proximal end 322 of the turnbuckle cable connector 320 prevents the turnbuckle cable connector from being pulled free of the canopy tensioner 301. The distal end 323 of the turnbuckle cable connector 320 is swaged to the second end 325 of the camber cable 312.

As one skilled in the art understands, the body 329 of the turnbuckle connector rotates on the threaded, proximal end 327 of the turnbuckle shaft, thereby increasing (or optionally decreasing) tension on the camber cable that is transferred through the canopy tensioners to the long 203 and short 204 arms. It is further understood that the connections of the camber cable to the canopy tensioners may be reversed without extending or modifying the scope and intent of the invention and such modifications are anticipated.

FIG. 3D illustrates the connections and relations among parts of the camber cable guide system 316: the connection of the camber cable 312 to the tensioners 301, bolted or otherwise connected to the front 110 and rear 111 fabric anchor extrusions, as well as the central axle tube 112 in relation to the rib hub 202, long 203 and short 204 arms, and the shade canopy 102. The fabric element 103 is suspended by a ridge tube 113; other than the front and rear fabric anchor extrusions, 110 and 111, respectively, the ridge tube 113 is supported by the ridge tube cradle 220 provides the only direct support of the fabric element 103.

The canopy tensioner 301 may be fabricated from metals and artificial materials. Preferably, the canopy tensioner is manufactured by injection molding from a plastic material, such as, but not limited to fiberglass filled nylon.

The dimensions of the canopy tensioner 301 are important only to the extent of adequate arm length to form the support arm chase 305 and camber cable chase 306 and adequate strength to allow secure connection to the fabric anchor extrusions and tolerate pressure exerted by rotation of the tension adjustment nut 307. Thus, the width 303A may vary, but is not limited to from 1 to 3 inches (2.5 to 7.5 cm), the height from 0.75 to 1.5 inch (1.9 to 3.8 cm), and the length also from 0.75 to 1.5 inch (1.9 to 3.8 cm). The respective diameter of the support arm chase 305 and camber cable chase 306 are nominally the same as or slightly greater than the diameters of the threaded ends 215 of the long and short arms (203 and 204, respectively) and of the camber cable.

The camber cable guide system 316 equalizes tension on the rib arm units 217 such that they are subject only to compression loading. A camber cable extends the full length of each rib arm unit 217, which length is effectively the width 105 of the fabric element 103, FIG. 2A. The camber cable 312 is anchored to the canopy tensioners 301 positioned at and connected to the distal 205 and proximal 206 ends of the rib arm unit 217. The fabric element 103 is tightened by extending the canopy tensioners 103. The desired degree of tightness may cause undesired, upward deflection of the ends of the rib arm units 217. Extension of the camber cable guide 313 eliminates this upward deflection and equalizes tension such that they are subject only to compressive loading. In addition, the effective length of the camber cable 312 can be changed by adjustment of the integrated turnbuckle cable attachment device 320.

Carrier Bracket Assembly

Figure 4A:
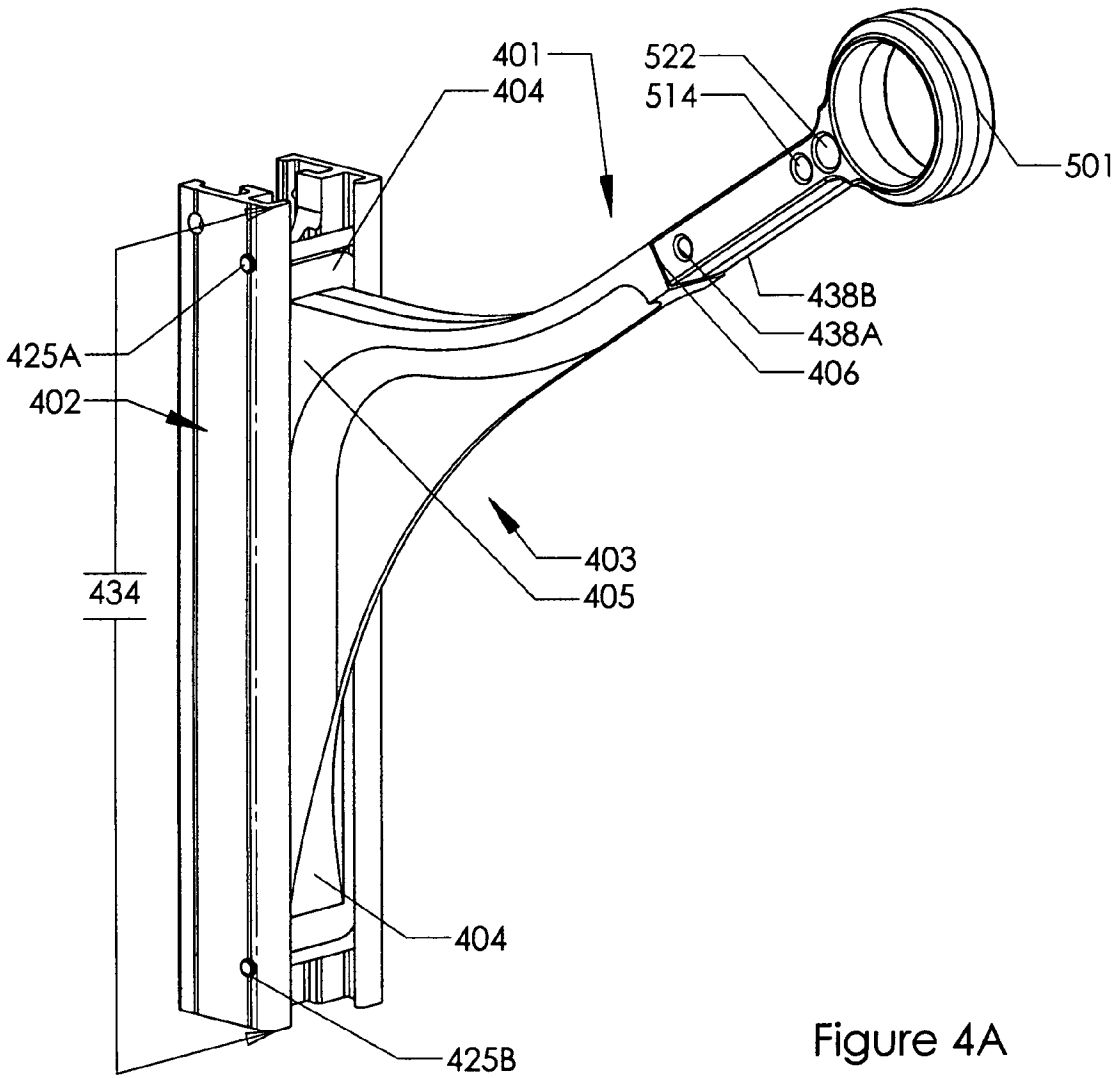
FIG. 4A illustrates carrier bracket assembly with carrier unit.
Figure 4B:
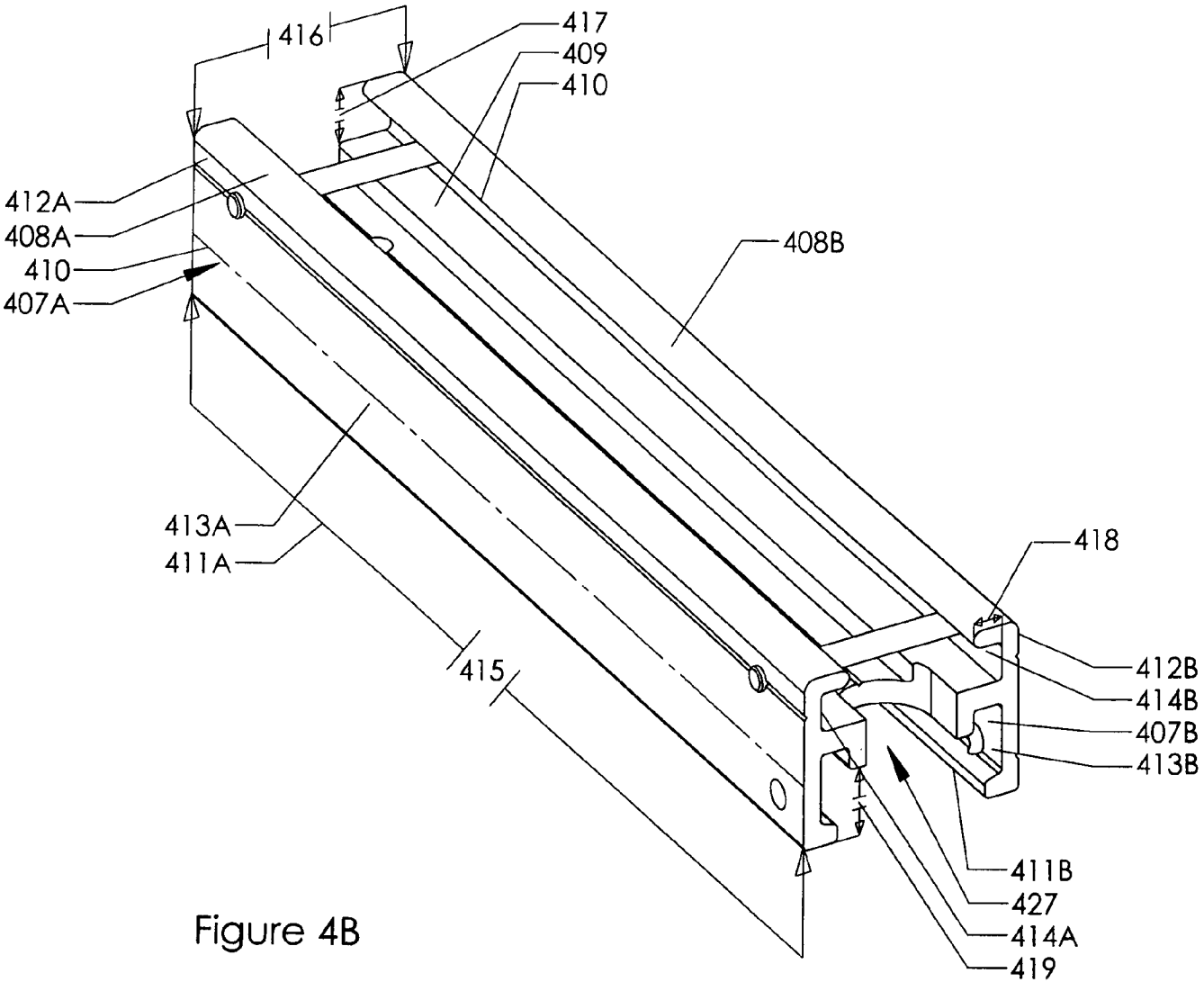
FIG. 4B illustrates details of mounting bracket showing dimensions and details of side walls.
Figure 4C:
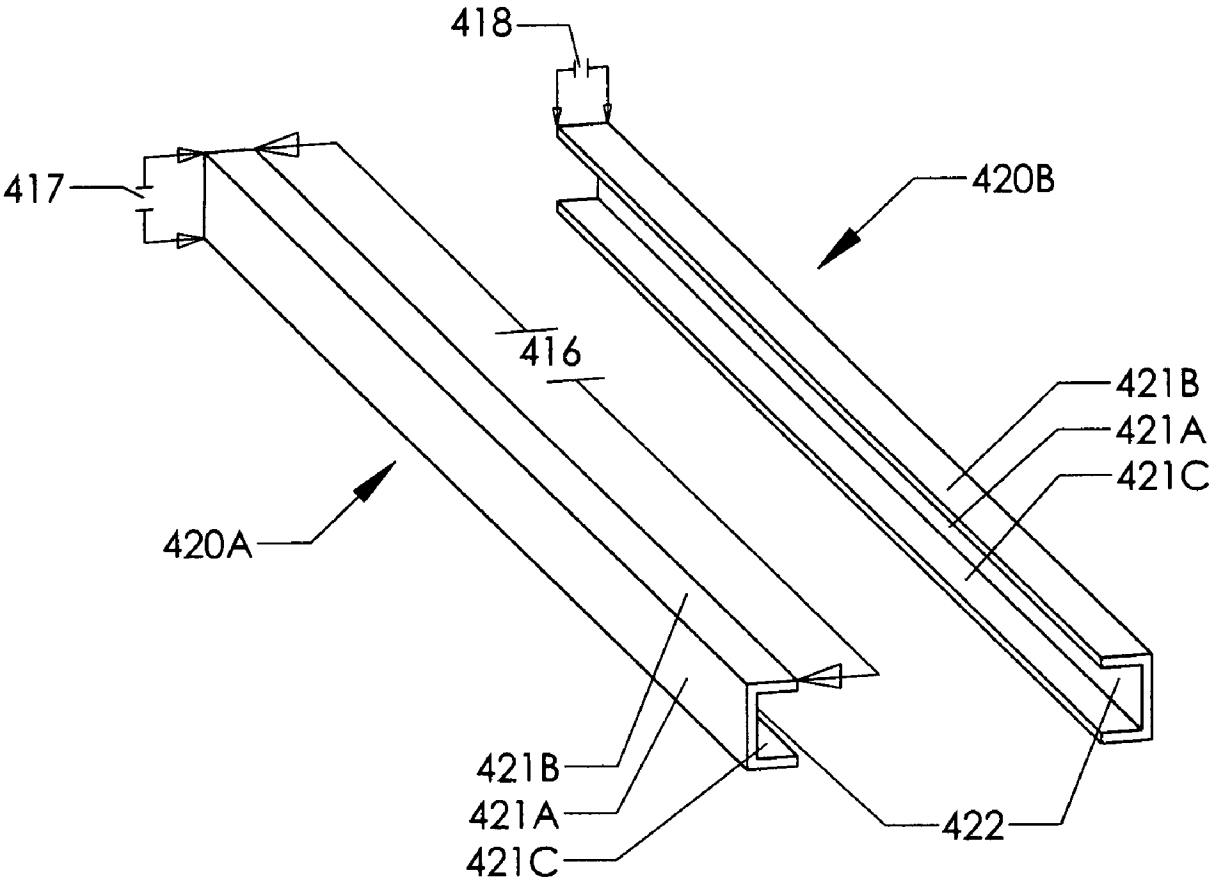
FIG. 4C illustrates structure of pair of flange guides.

FIG. 4A illustrates the complete carrier bracket assembly 401 including the mounting bracket 402 and carrier unit 403. Details of the mounting bracket 402 are shown in FIGS. 4B and 4C and details of the 4E.

The carrier bracket assembly 401, FIG. 4A, comprises two major elements: a mounting bracket 402 and a carrier unit 403. The carrier unit 403 comprises a base flange plate 404 and a support arm 405. The distal end 406 of the support arm 405 is adapted, as the connector tongue 405A, to engage and support the axle support ring element 501. The dimensions of the connector tongue 405A, by way of example, not limitation, are length 513, 2 to 4 inches, preferably 3 inches (5 to 10 cm, preferably 7.5 cm), width 512, 0.75 to 1.50 inches, preferably 1.2 inches (1.9 to 3.8, preferably 3.0 cm), and height (or thickness) 511, 0.3 to 0.7 inch, preferably 0.5 inch (0.75 to 1.78 cm, preferably 1.27 cm).

The support arm 405 and base flange plate 404 are comprise a single unit, commonly manufactured from die-cast aluminum processes. As illustrated in FIG. 4A, the support arm 405 extends outwardly and upward at a shallow angle from the base flange plate 404.

In a common configuration, the mounting bracket 402 is physically attached to the face of the building, thereby serving as the actual connection of the entire louver shade assembly with the building. Further, the mounting bracket 402 physically engages the base flange plate 404, thereby connecting the carrier bracket and building.

Figure 4D:
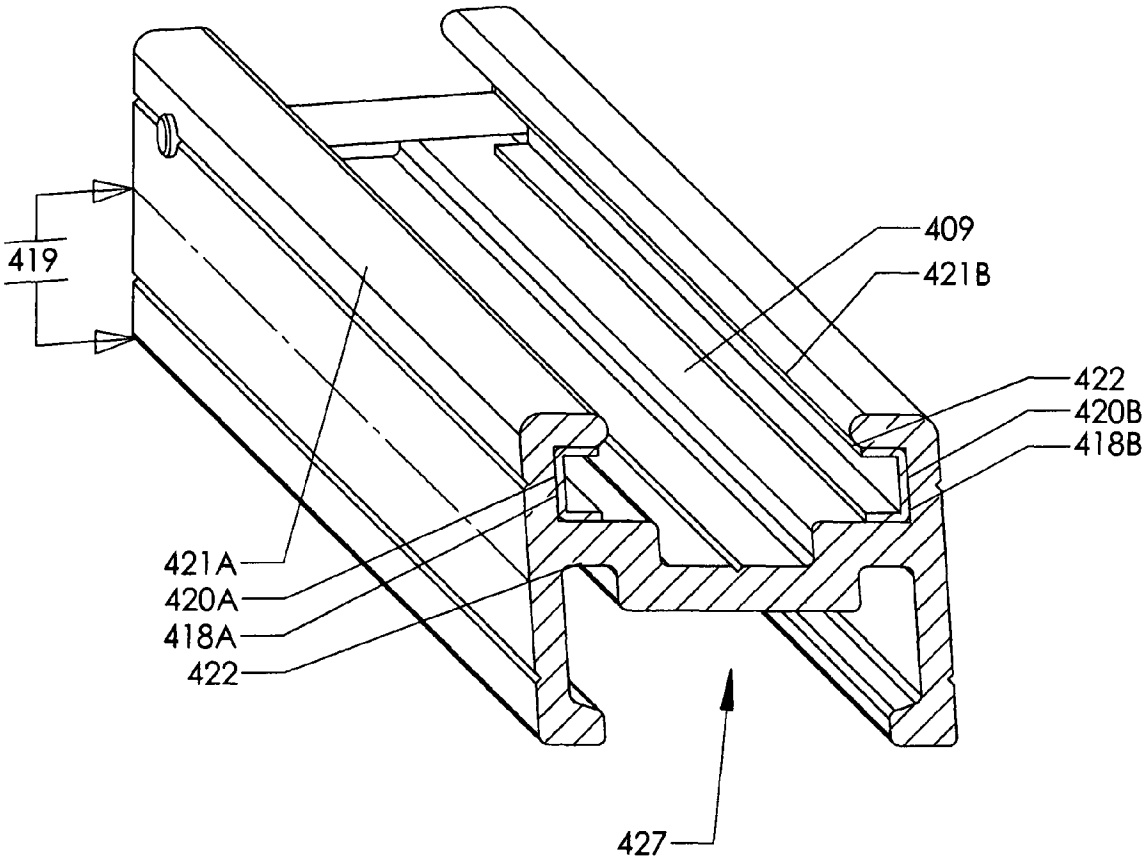
FIG. 4D illustrates flange guides positioned in flange guide channels of carrier bracket.

The mounting bracket 402, FIGS. 4B, 4C, and 4D comprises a first side wall 407A and a second side wall 407B. The top edge of the first side wall 407A bends inward at a right angle to form the first top wall 408A; similarly, the second side wall 407B bends inward to form the second top wall 408B. The first side wall 407A and second side wall 407B are connected by bottom wall 409 along a line 410 on each side wall that is parallel to the bottom edge of each side wall 411A and 411B, respectively. The line 410 divides the first side wall 407A into a first upper side wall 412A and a first lower side wall 413A and the second side wall 407B into a second upper side wall 412B and a second lower side wall 413B.

As diagrammed in FIG. 4C and FIG. 4D, the first upper side wall 412A, the first top wall 408A, and the bottom wall 409 define and limit the first flange guide channel 414A; similarly, the second upper side wall 412B, the second top wall, and the bottom wall 409 define and limit the second flange guide channel 414B.

One member of an identical pair of flange guides 420A and 420B is positioned in each is positioned and secured in each flange guide channel 414A and 414B. Each flange guide 420A/B comprises a back 421A, a top 421B, and a bottom 421C. These three sides define and limit a flange guide slot 422. The back 421A, top 421B, and bottom 421C have directly corresponding parts of the carrier mounting bracket: the bottom wall 409, first/second upper side wall 412A/B, and first/second top wall 408A/B. For convenience of illustration. a space is shown between the mounting bracket and corresponding flange guide. One skilled in the art recognizes that opposing walls are in physical contact and physically connected commonly with an appropriate adhesive.

The flange guides 420A/B are extruded from a low friction material, such as, but not limited to, nylon.

Dimensions (length 416, height 417, and depth 418) are comparable to the dimensions of the flange guide channels in which the flange guides are positioned and to the length 415 and width 416 of the mounting bracket 402. Length varies from 6 to 24 inches (15 to 15 to 60 cm), preferably from 12 to 18 inches (30 to 45 cm), height varies from 0.25 to 0.75 inch (0.32 to 1.90 cm), and depth from 0.25 to 1.0 inch (0.63 to 2.54 cm). It is to be understood that the actual length of the flange base 434 is less than the length of the carrier bracket so as to provide space for positioning the flange stay pins 425A and 425B.

Figure 4E:
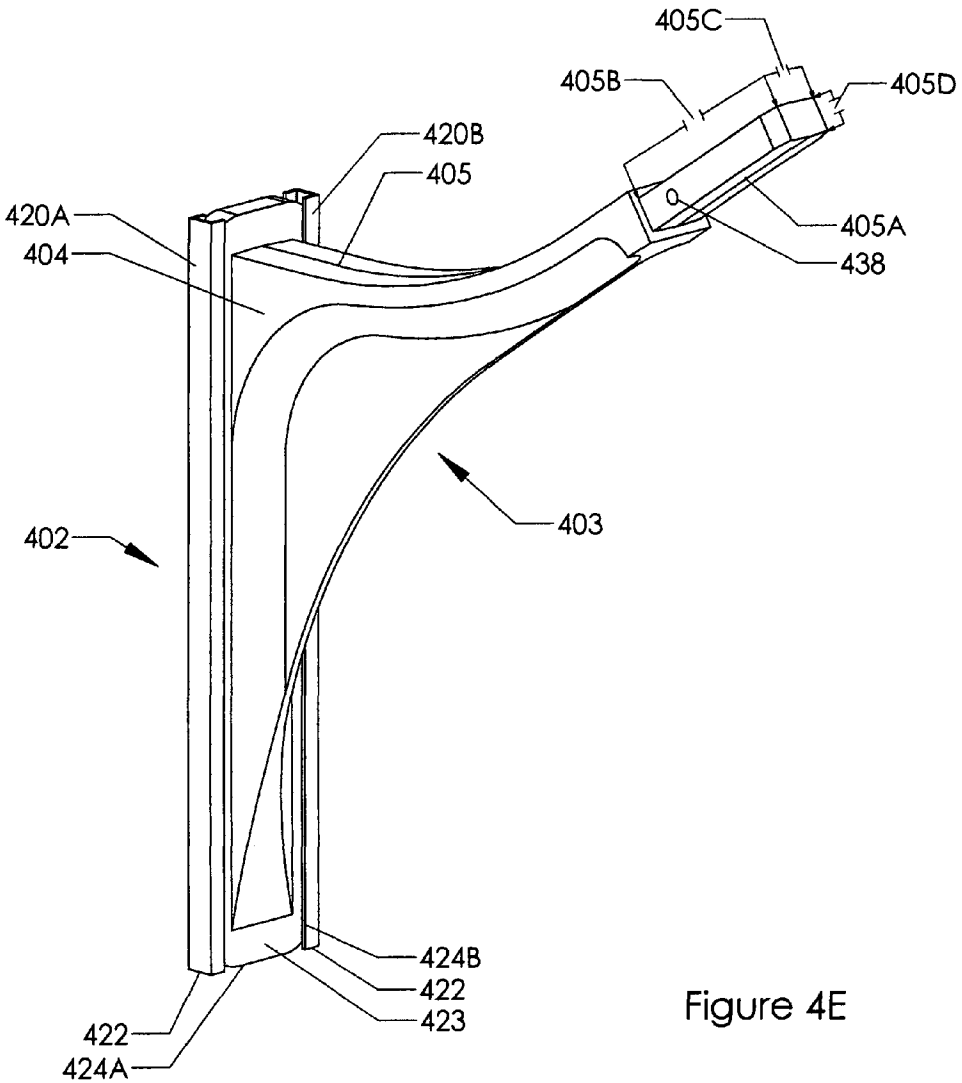
FIG. 4E illustrates structural details of carrier unit.

FIG. 4E shows the carrier unit 403 engaged with (connected to) the mounting bracket 405. The base flange plate 404 comprises three contiguous segments: a central segment 423 that constitutes the base of the support arm 405 and a pair of flange lips 424A and 424B each of which extends the full length of the base flange plate 404, and each of which is nominally the same dimension (width, height, and depth) as the guide slot 422. Engagement (connection) of the carrier unit 403 and mounting bracket 402 is achieved by the first 424A and the second 424B flange lip being inserted full-length into the corresponding guide slot 422, as illustrated; the identical guide slots 422 are secured as previously described in first and second guide channels 414A and 414B (FIG. 4D). In FIG. 4E, the flange plate 404 is illustrated extending from the mounting bracket 402. This is a matter of convenience for illustrative purposes; the lengths of the mounting bracket 402 and base flange plate 404 are generally equal.

Figure 4F:
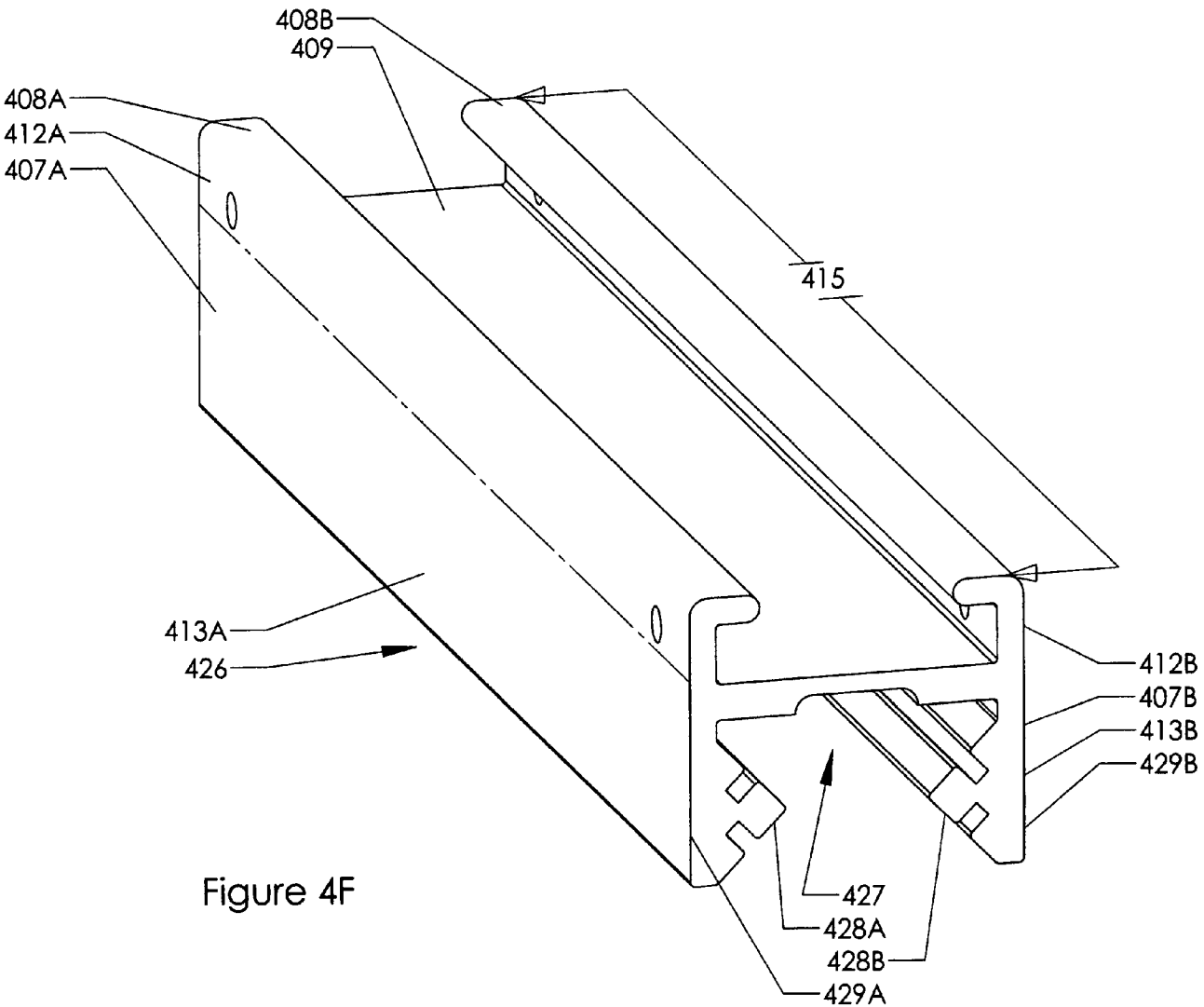
FIG. 4F provides a 3-dimensional view of modified mounting bracket with wedge guides extruded as part of the lower body chamber.
Figure 4G:
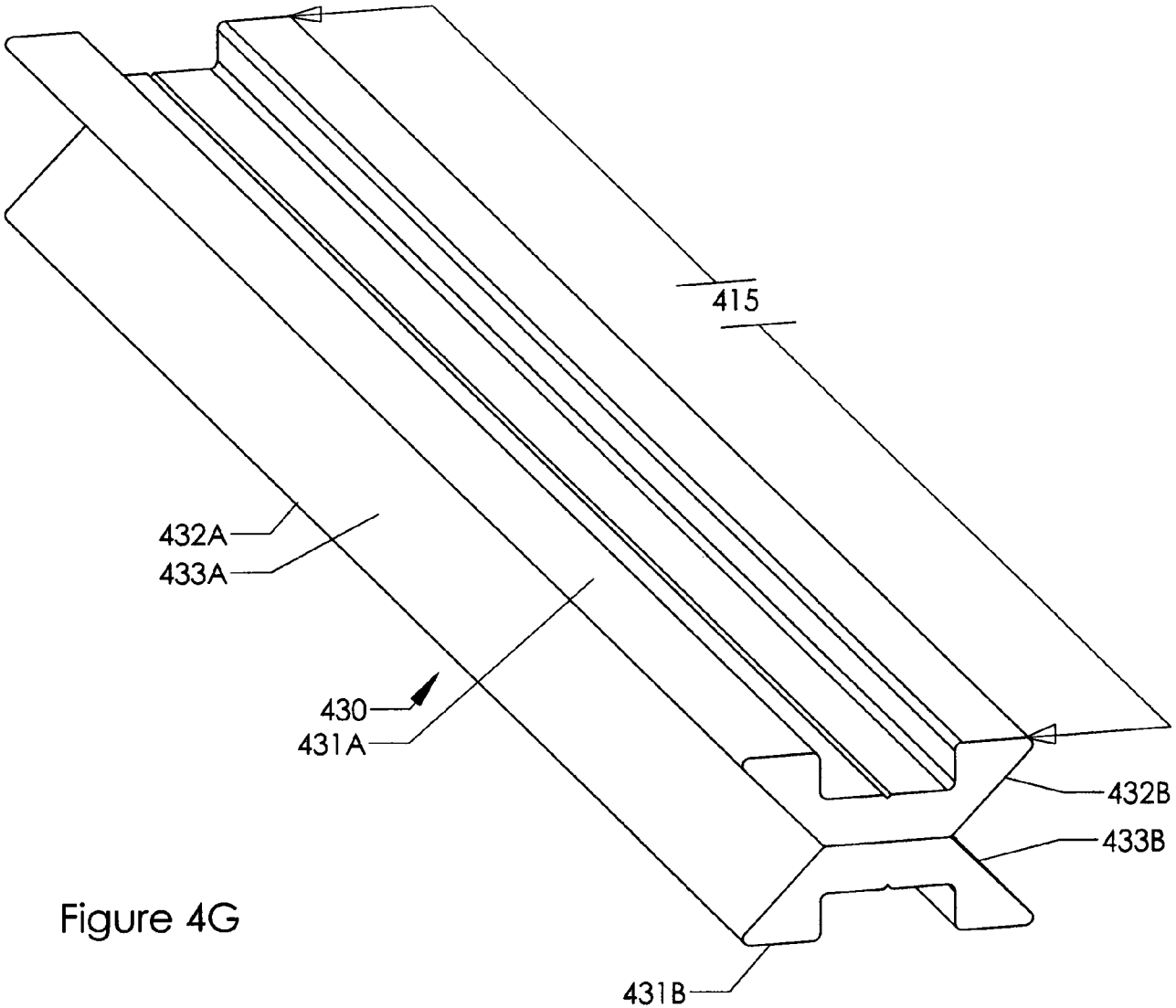
FIG. 4G illustrates dove-tail mounting plate.
Figure 4H:
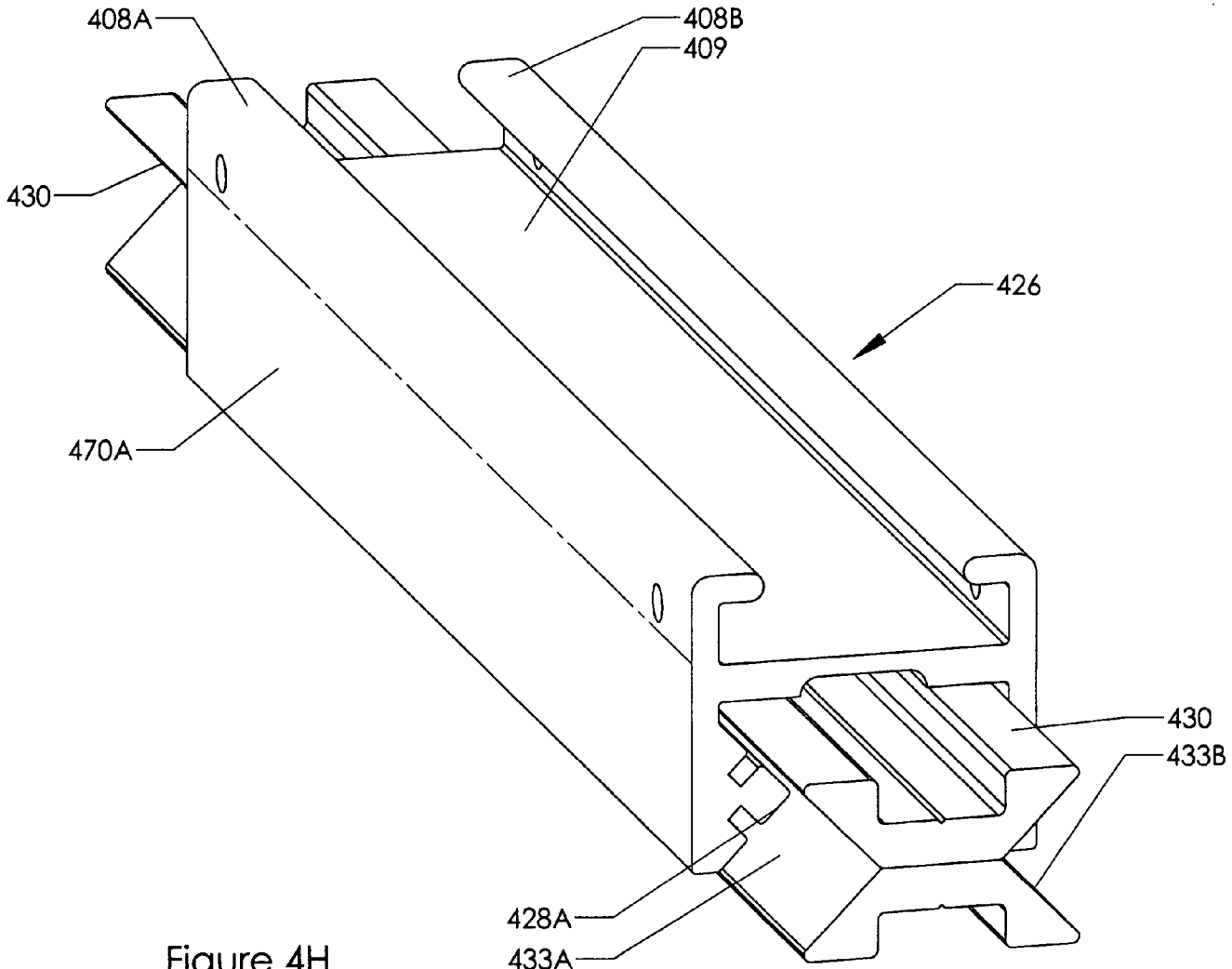
FIG. 4H illustrates engagement of the dove-tail mounting plate with rails.

FIG. 4F and FIG. 4G in combination illustrate an alternative configuration for connecting the louver assembly to a building or window frame structure and allowing for both vertical (elevation) and pitch adjustments. In the alternative configuration, a dove-tail mounting plate 430 (FIG. 4G) is attached directly to the building. A modified mounting bracket 426 (FIG. 4F) engages the dove-tail mounting plate. Functionally, the modified mounting bracket 426 is identical to mounting bracket 402 with the following modifications. Members of a pair of wedge guides 428A and 428B are extruded as part of the interior 427 surfaces 429A and 429B of the first 413A and second 413B lower side walls. The wedge guides extend the full length 415 of the modified mounting bracket 426.

The dove-tail mounting plate 430 is at generally twice as long 415 as the modified mounting bracket 426. A first 433A and a second 433B v-notch extends the full length of the dove-tail mounting plate 430 on the first and second side 423A and 423B, respectively, of the dove-tail mounting plate 430. The size and shape of the wedge guides 428A and 428B are identical and complimentary to the size and shape of the first 428A and second 428B v-notches rails. The wedge guides engage the v-notch thereby connecting the modified carrier bracket to the modified carrier bracket 426 to the dove-tail mounting plate. With in the limits of the length of the dove-tail mounting plate, the positioning of the modified mounting bracket may be adjusted vertically.

Axle Support Ring Element

Figure 5A:
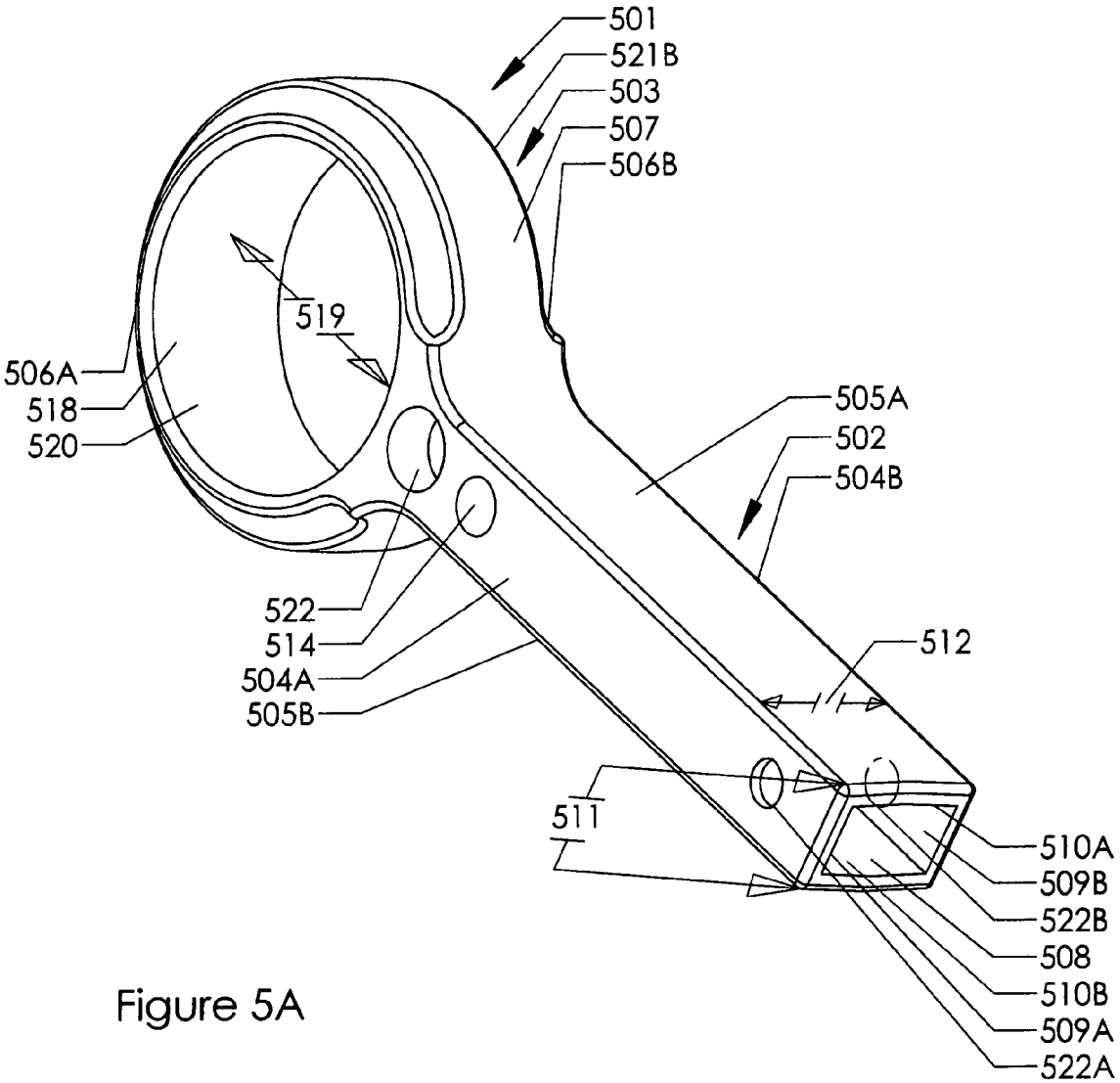
FIG. 5A provides details of axle support ring and support chase.
Figure 5B:
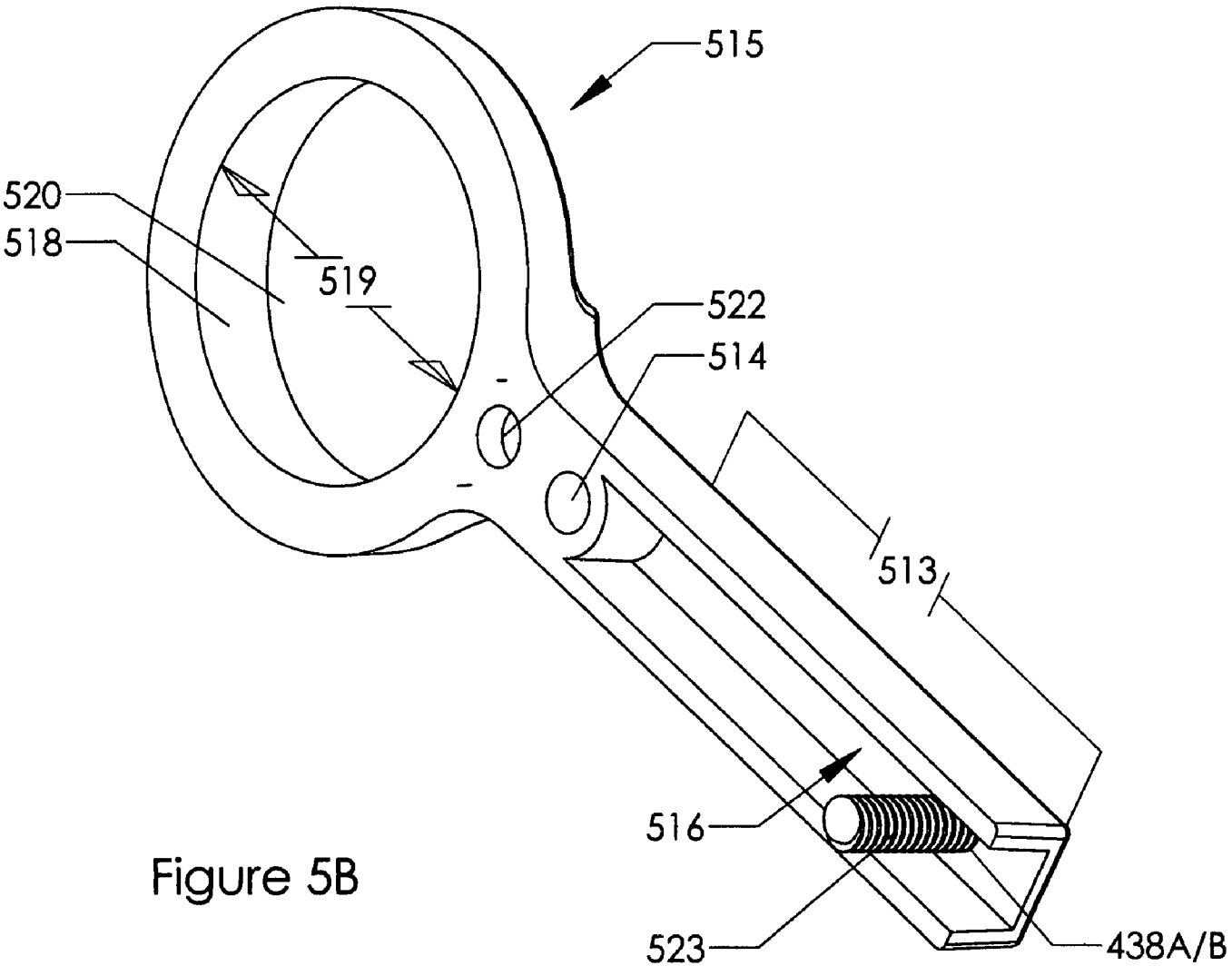
FIG. 5B provides details of axle support ring in half-section view.

FIGS. 5A and 5B provide details of the axle support ring element 501. The axle support ring element 501 comprises two segments, the connector tongue chase body 502 and the axle tube chase support 503. Commonly the axle ring support element 501 is injection molded in individual, complimentary half sections 515 from, by way of example, not limitation, a blend of fiberglass and nylon.

The connector tongue chase body 502 comprises connected structural elements as follows: a first face wall 504A and a second face wall 504B and a first side wall 505A and a second side wall 505B. The receptacle tongue chase 508 is defined and limited by the inner surfaces 509A and 509B of the first and second face walls 504A and 504B and by the inner surfaces 510A and 510B of the first and second side walls 505A and 505B, respectively. The receptacle tongue chase has a height 511, a width 512, and a length 513, the dimensions of which are nominally the same as the dimensions of the connector tongue 405A.

The central axle tube chase support 503 segment is defined by the first and second faces of the central axle tube chase support walls 506A and 506B, respectively. The chase lumen 520 is defined and limited by the inner surface 518 of the first and second central axle tube chase walls 506A and 506B and the circular support wall 507. The diameter 519 of the lumen 520 is nominally equal to the diameter of the rotatable central axle tube is generally, but not limited to, 1 to 3 inches (2.5 to 7.5 cm).

The connector tongue 405A is positioned in and engages the connector tongue chase 508, thereby connecting the axle support ring element 501 to the support arm. The half-sections 515 of the axle support ring element 501 are physically connected, thereby securely clamping the connector tongue 405 in the connector tongue chase. A first clamping bolt traverses the first 504A and second 504B face wall at a point 522 and, when secured with a nut, serves to clamp the engaged, connector tongue 405A in the connector tongue chase 508. In addition, a second clamping bolt 523 traverses the first 504A and second 504B face walls at a points 522A and 522B respectively and traverses connector tongue 405A at chase 438; thus, when secured with a nut, the second clamping bolt 523 in conjunction with the first clamping bolt securely connects the complimentary half sections 515 and locks the connector tongue 405A in position in the connector tongue chase 508.

The connector tongue chase body 502 further comprises a lift arm anchor point 514 that traverses the first and second faces 504A and 504B, respectively.

Functionally, opposing half-sections 115 of the axle support ring element 501 are positioned on the central axle tube 112 and connected at the connecting traverse point 522 and is secured by a bolt and locking nut. Actual connection is by means of the central axle tube 112 being positioned in the chase lumen 520 of the central axle tube chase support segment 503. The connector tongue 405A is positioned in the connector tongue chase 508, and the locking bolt 438D positioned through the first receptacle face 504A at a point 438A traverses 438B the connector tongue 405A, and traverses the second face 438C and is secured in position with a locking nut. Thus, the carrier bracket assembly 401 and louver assembly are structurally and functionally connected. One skilled in the art understands that the above reference to "bolts" and locking nuts" includes a wide array of hardware connectors all of which are anticipated by reference without modifying or expanding the scope or purpose of the invention.

Figure 5C:
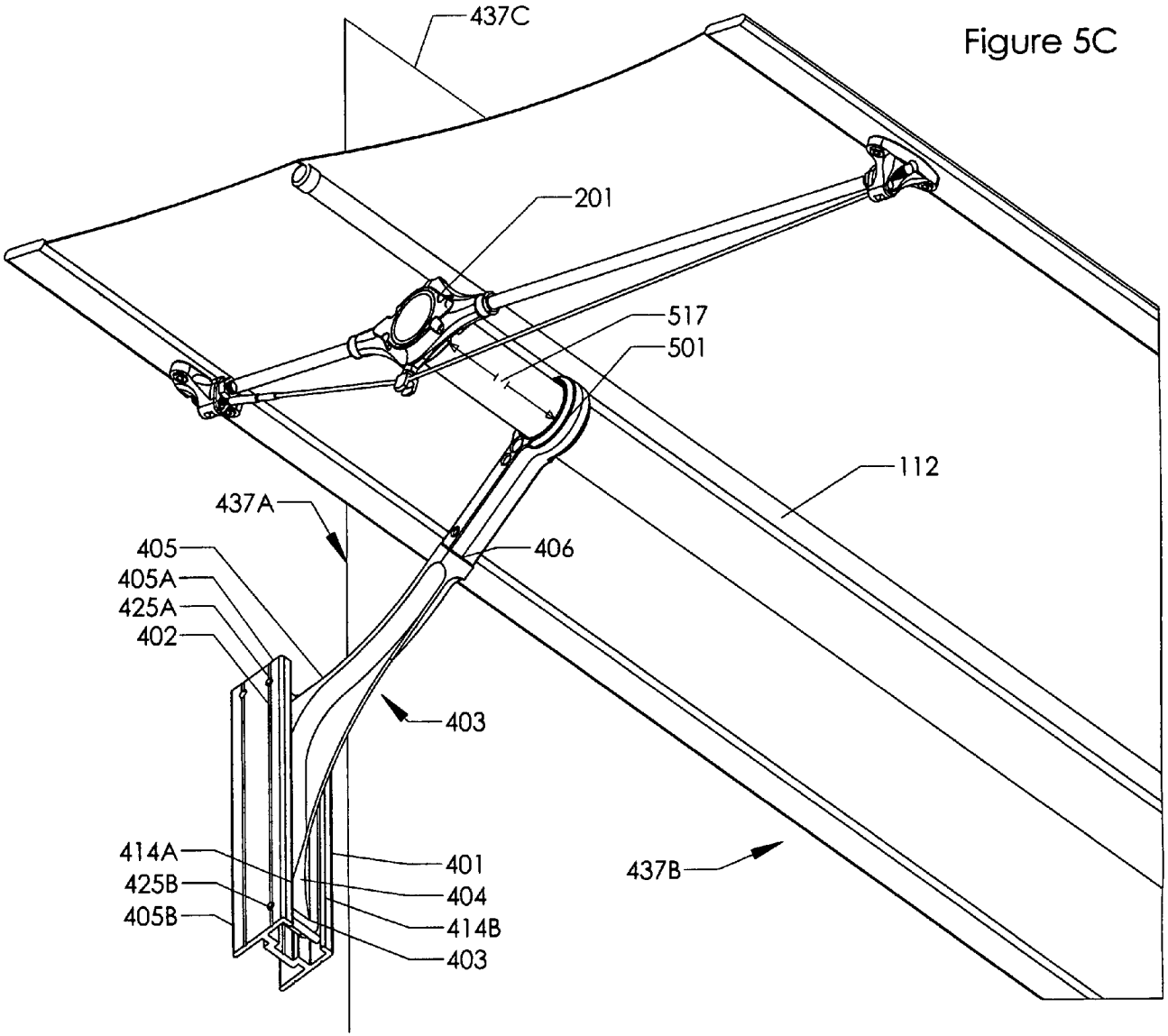
FIG. 5C illustrates mounting bracket positioned on building and relationship of carrier bracket, shade canopy, and rod rib assemblies.

FIG. 5C illustrates the carrier bracket assembly 401 positioned on a wall 437A of a structure adjacent to a window 437B. The mounting bracket 402 is secured to the wall such that the central axle tube 112 is generally positioned below and parallel to the upper edge 437C of the window 437B. One skilled in the art is familiar with a variety of connector devices appropriate to secure the mounting bracket 402 to the wall 437A suitable for the design and materials of the building. The base flange plate 404 is positioned in the first and second flange guide channels 414A and 414B, and the base flange 404 is secured in is vertical orientation by the upper 425A and lower 425B flange locking pins. The central axle support ring 501 is connected by the connector tongue chase 502 to the support arm 405, and the central axle tube 112 is positioned in the chase lumen 520 and supported by the carrier brackets 401. The carrier bracket assembly 401 is positioned on the central axle tube 112 at a distance 520 of 3 to 12 inches (7.5 to 30 cm) from either end of the central axle tube 112. The carrier brackets assemblies 401 are positioned in pairs with one member of a pair on each side of the window, or group of windows to be shaded, and members of the pair are equally spaced from the corresponding end of the central axle tube, as described above.

Control of Shade Canopy Pitch

The pitch of the shade canopy can be altered by controlled rotation of the rotatable central axle tube. Pitch is described as the slope downward of the front edge (and concurrent slope upward of the back edge) of the shade canopy from horizontal. Increasing pitch increases shading by the shade canopy. This, for convenience, is referred to as the shade orientation of the canopy. The normal (default) position of the shade canopy is generally defined as horizontal orientation; however it may also be defined as the pitched or shade configuration.

The shade canopy may be rotated by elevating the rear fabric anchor extrusion, thereby increasing the pitch and increasing shading and cooling. Optimum pitch considers exposure (east and west versus south) and latitude and regional daily and seasonal temperature patterns.

Thermally induced, automatic modification of the pitch is achieved by the use of a compression gas spring or a combination of a compression gas spring and wax piston assembly to stabilize the pitch of the shade canopy or to rotate the shade canopy by elevating the rear fabric anchor extrusion.

Wax Piston Assembly

Figure 6A:
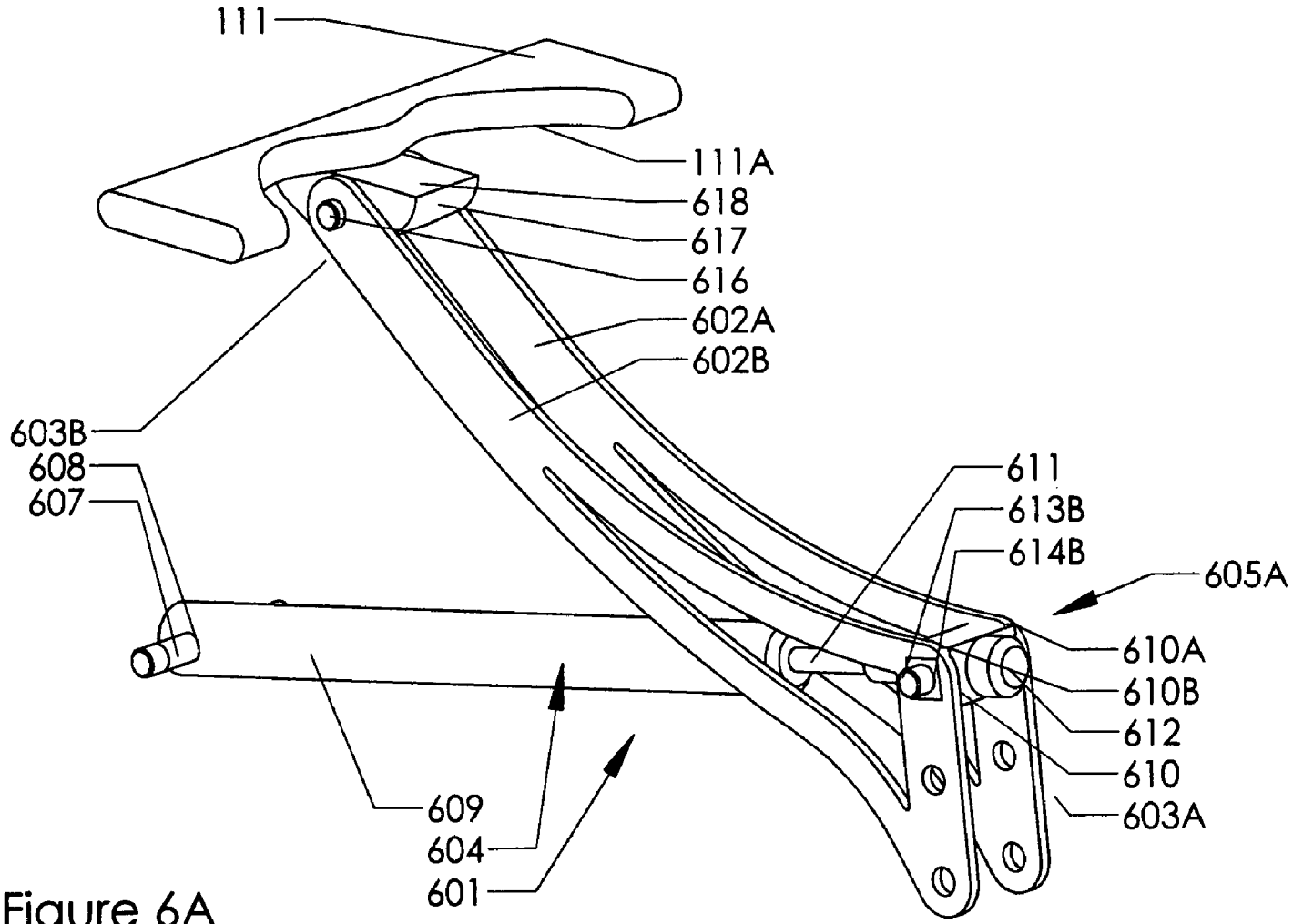
FIG. 6A illustrates wax piston assembly in relation to lift arms and rear fabric anchor extrusion.

The wax piston assembly 601, FIGS. 6A,B,C, and D is the mechanism by which the orientation of the shade component is changed from the default, horizontal orientation to provide greater shading and related cooling. The wax piston assembly 601 comprises two lift arms 602A and 602B, a wax cylinder unit 604, a piston support block 610, and a lift arm block 617 the top surface of which 617A contacts the fabric anchor extrusion 111.

Both the first 602A and second 602B lift arms have a proximal end 603A and a distal end 603B. The lift arm block 617 is pivotally attached at the distal ends 603B to both lift arms 602A and 602B by attachment pin 616. The piston support block 610 is pivotally attached to the proximal ends 603A of the first 602A and second 602B lift arms at attachment points 614A and 614B by the connecting lugs 613A and 613B. This pivotally secures the piston support block 610 between the two lift arms 602A and 602B. The first 613A and second 613B piston block connection lugs are functionally part of the piston support block 610. Practically, the lugs 613A and 613B may be threaded respectively into the first 610A and second 610B side face and aligned with the corresponding attachment points 614A and 614B. The lugs traverse the respective lift arms and are secured with bolts or comparable means known to those skilled in the art, thereby securing the piston support block 610 between the two lift arms, 602A and 602B.

Figure 6B:
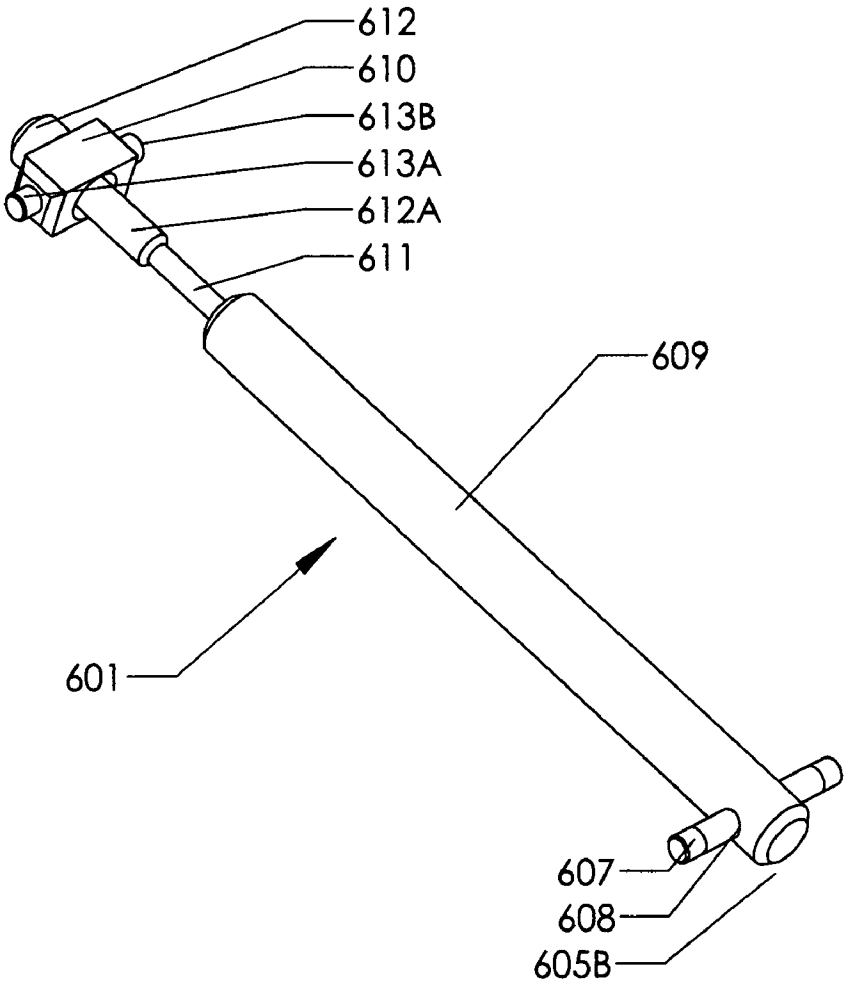
FIG. 6B illustrates details of wax piston assembly.

The wax cylinder unit 604 is connected to the piston support block 610. The threaded piston adjuster 612 at the proximal end 603A of the wax cylinder unit 604 engages the corresponding, threaded piston chase 612A. Thus, the wax cylinder unit 604 through connection with piston support block 610 is physically connected to the first 602A and second 602B lift arms. Details of the piston support block 610 and wax piston unit 604 are illustrated in FIG. 6B. The wax piston unit comprises a cylinder 609 with a piston 611 functionally connected to it and to the piston adjuster 612 extending from the threaded piston connection channel 612A at the distil end 605A of the piston support block 610.

The upper surface 618 of the lift arm block 617 contacts the bottom side 111A of the rear fabric extrusion 111. The cylinder 609 contains a heat reactive, wax material that expands with increasing temperature, and in response to increasing temperature, the wax expands exerting a force on the piston 611. The piston is mechanically and functionally connected to both the cylinder 609 and to the threaded piston adjuster 612 that is connected to piston support block 610.

Figure 6C:
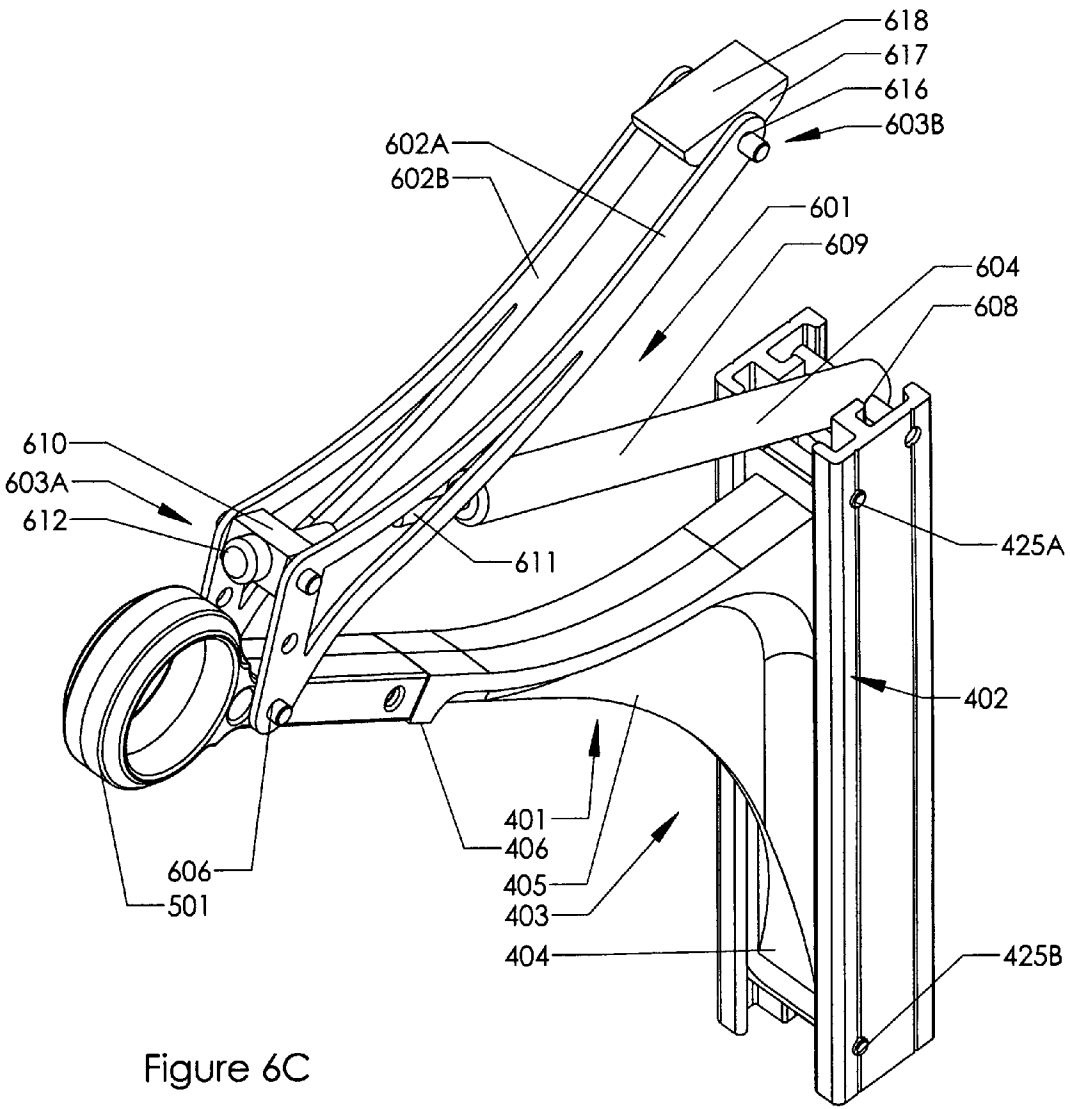
FIG. 6C shows relative positions and structures of wax piston assembly, support arm, carrier bracket, and axle support ring.

Structurally and functionally, the wax piston assembly 601 is connected to the mounting bracket 402. The cylinder 609, as illustrated in FIG. 6C, is connected by the upper flange stay pin 425A that traverses the mounting bracket 402 and engages the cylinder attachment point 608. One skilled in the art recognizes that the cylinder 609 may be connected by an axle or pin located separately from the upper flange stay pin 425A without changing the scope or intention of the invention, and such modifications are anticipated and included as part of the invention.

The wax piston assembly 601 is connected to the carrier support arm 405 (FIG. 6C) indirectly as follows. The piston support block 610 is directly connected to lift arms 602A and 602B by the piston support block connecting lugs 613A and 613B. The lift arms 602A and 602B are connected the support arm 405 by lift arm anchor pin 606. Thus, the wax cylinder unit 604 is connected directly to the carrier bracket 402 through connection of the cylinder 609 through attachment point 608 by upper flange stay pin 425A. The wax cylinder unit 604 is connected by linkage of the threaded piston adjuster 612 linkage with piston support block 610 and the piston support block 610 being pivotally connected through piston support block connecting lugs 613A and 613B with corresponding lift arms 602A and 602B, and connection of lift arms by connection with the carrier bracket support arms 405. The carrier support arm 405 is attached to carrier bracket base flange 404, which is structurally and functionally connected to the wall mounting bracket 402.

The wax piston assembly 601 and its support as described above explain how the pitch of the shade component 102 is adjusted in response to increases in temperature. The upper surface 618 of the lift arm block 617 contacts the bottom side 111A of the rear fabric anchor extrusion 111. The cylinder 609 contains a thermal reactive wax material that expands in response to increases in temperature, thereby exerting a force on the piston 611. The force is transferred to piston support block 610 causing it to rotate on lugs 613A and 613B. The rotation in response to the force is transferred to the lift arms 602A and 602B causing the support arms to rise, exerting an upward force on back edge fabric anchor extrusion 111 causing it to rise, there by rotating the shade component 102 downward, or lowering its pitch and, thus, increase shading of an adjacent surface (window).

One skilled in the art understands that the response of the wax piston assembly to temperature change can be controlled by the threaded piston adjuster 612 that effectively determines the temperature required to generate force on the second fabric extrusion 111. Also, one skilled in the art recognizes that without affecting or increasing the scope or intent of the invention, the horizontal default orientation of the shade canopy assumed in the preceding examples can be modified by mechanically adjusting the height or angle of attachment of the lift arms or angle of attachment of cylinder 609 to the carrier bracket, and all such simple alterations are assumed by this specification.

Because up to 75 percent of the weight of the louver assembly is centered on the long arm side of the central axle 112, the shade component 102 does not rotate back to the default position when the wax cylinder is cooled. A compression gas spring 701 (FIG. 7A) provides the force to return the shade component to its default position, as force from the cylinder is reduced in response to cooling.

The wax piston assembly 601 is uni-directional in function. As temperatures increase, the wax expands to exert pressure on the piston ultimately to force the rear anchor extrusion 111 upward, or increase the pitch of the shade canopy 102. When the temperature decreases adequately, the wax cools and contracts, and the pressure decreases, but does not generate a force to pull the rear anchor fabric extrusion 111 down and rotate the shade canopy 102 back to its default, horizontal position. The force is supplied by a compression gas spring assembly 701, as illustrated by FIG. 7A and FIG. 7B.

Compression Gas Spring

Figure 7A:
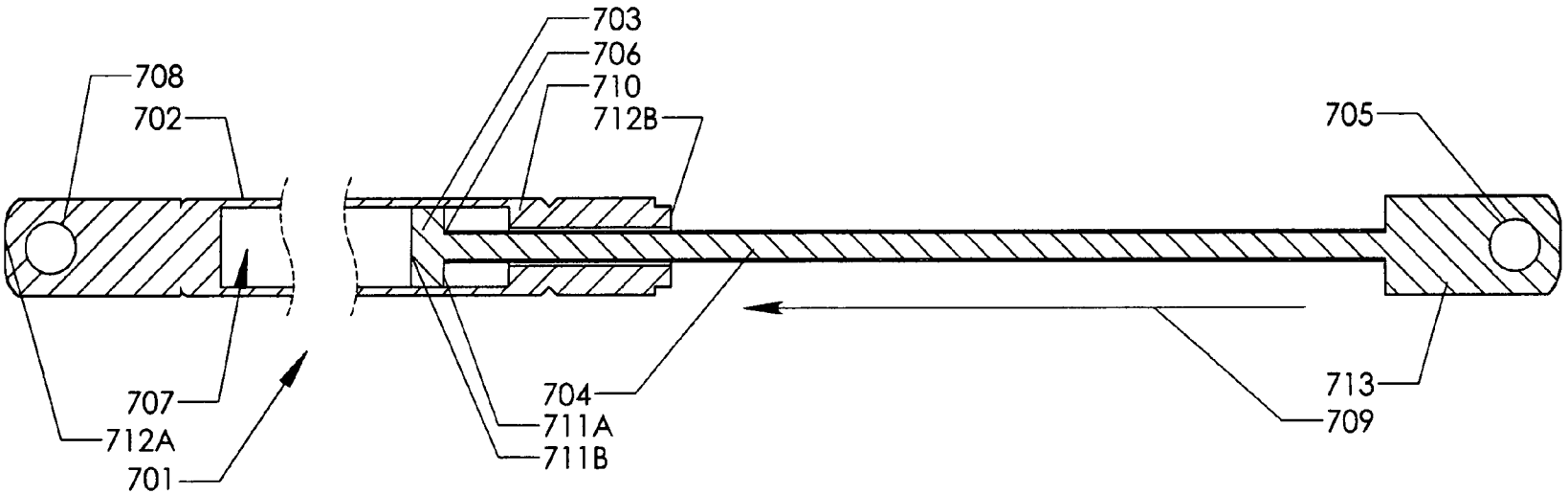
FIG. 7A is a diagram of a decompressed, compression gas spring with the piston fully extended.
Figure 7B:
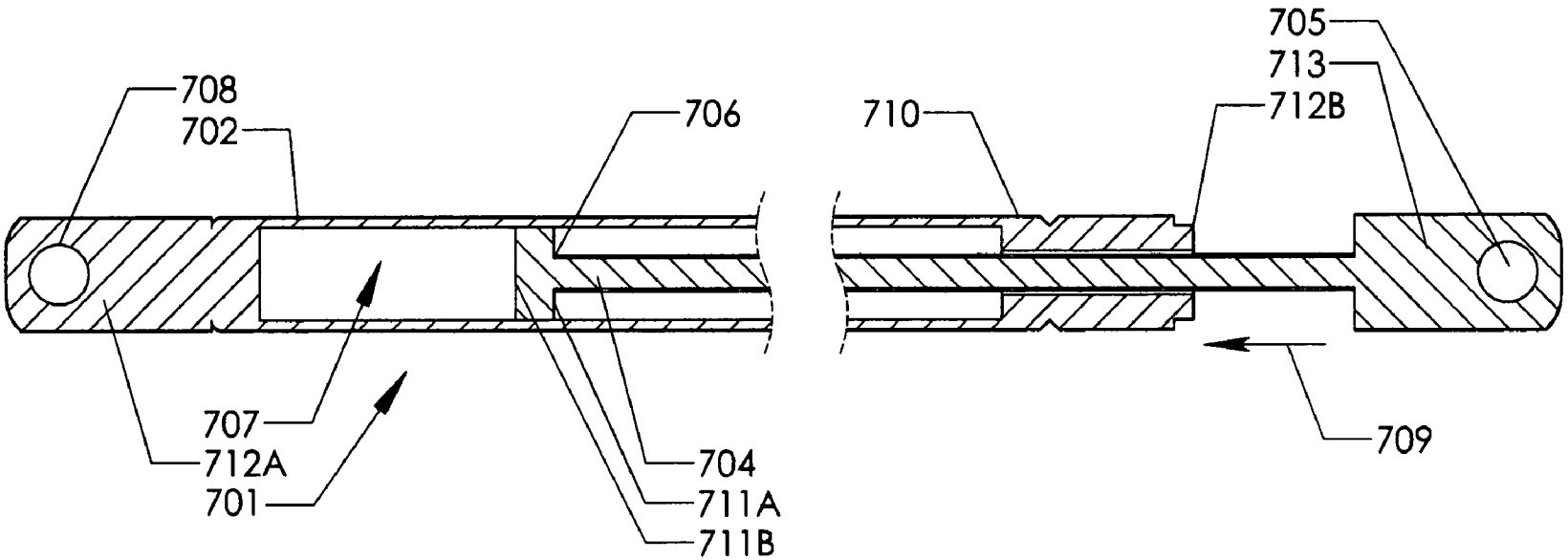
FIG. 7B is a diagram of a compressed (pressurized), compression gas spring with the piston fully retracted.

The compression gas spring 701 FIGS. 7A and 7B comprises three basic parts: a cylinder (or tube) 702, a piston 703, and a piston arm 704. The proximal end 706 of the piston arm 704 is secured to the bottom surface 711A of the piston 703, and the piston arm 704 traverses the bottom cap of 712B of the cylinder 702, with the distal end 704 of the piston arm 704 extending beyond the bottom cap 712B. The distal end 705 of the piston arm 704 terminates in the piston arm connector 713. The volume of the cylinder starting at the upper surface 711B of the to the top cap 712A comprises the compression chamber 707. The volume of the cylinder below the piston comprises a lubricant sink 710. With no external, upward force applied to the piston arm arrow 709, the piston is positioned in and lubricated by oil in the lubricant sink 710.

Upward, compressing force, arrow 709, on the piston arm 705 drives the piston upward, compressing the gas (commonly nitrogen gas) in the compression chamber 707; compare the relative position of the piston 703 in FIG. 7A versus FIG. 7B and the volume (reflected by the area) of the compression chamber 707 in FIGS. 7A and 7B. The compressed gas as illustrated in FIG. 7B is a source of potential (stored) energy. When the compression force, arrow 709, is terminated, stored energy represented by the compressed gas in the compression chamber 707 drives the piston downward, opposite to the direction of the arrow 709.

In one mode, the shade canopy is maintained in a horizontal orientation. The shade canopy may be temporarily rotated to an increased pitch orientation, for example, in response to an accumulation of snow, or other material or debris or comparable conditions under which temporary rotation may be favorable, if not necessary to remove the material. When the conditions subside (the snow melts or is removed), the shade canopy rotates back to is default, horizontal orientation.

Figure 7C:
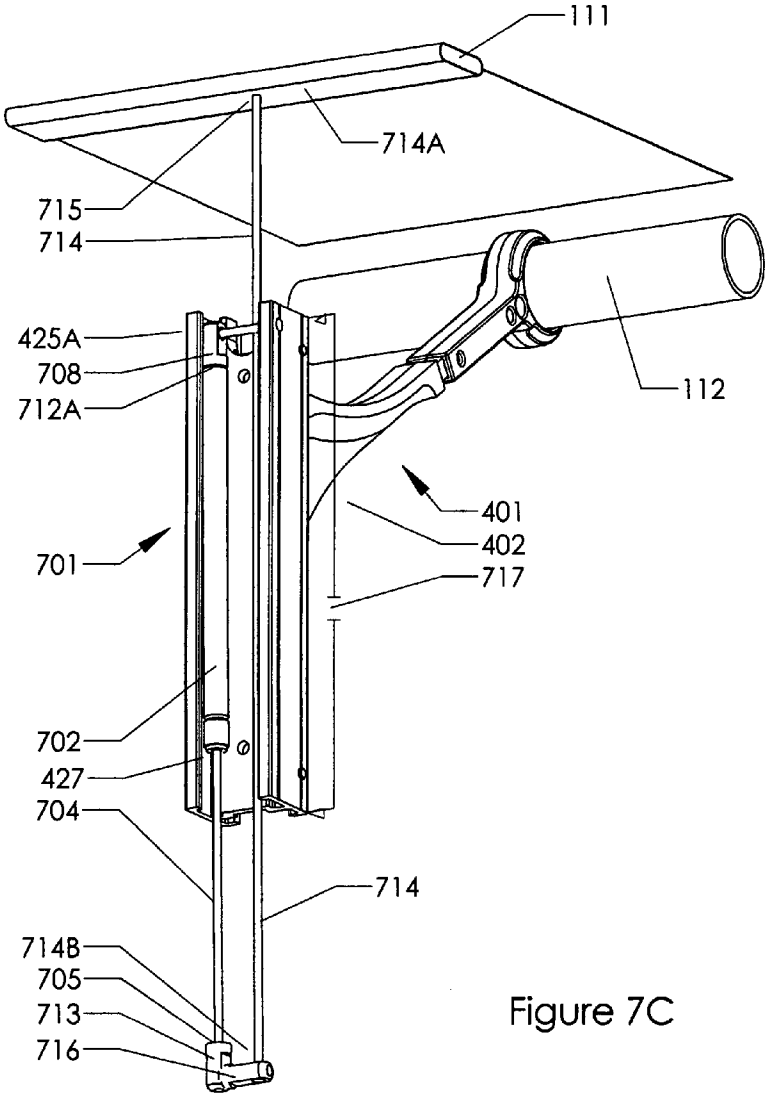
FIG. 7C illustrates compression gas spring positioned to maintain shade canopy in a default, horizontal orientation.

As illustrated in FIG. 7C a compression gas spring provides the force to pull the rear fabric anchor extrusion 111 downward, rotating the shade canopy to its default, horizontal orientation.

A first flange stay pin 425A connects the gas cylinder anchor eye 708 positioned on the top cap of the cylinder 712A to the mounting bracket 402. The compression gas spring cylinder 702 is positioned in the lower body chamber 427 of the mounting bracket 402. The first end 714A of the connecting cable 714 is secured to an anchor point 715 on the rear fabric anchor extrusion 111. A cord connector 716 is attached to the second end 714B of the connecting cable 714 and the cord connector 716 also connected to the piston arm connector 713 which is connected to the distal end 705 of the piston arm 704. The length of the cord 717 is set such that when the piston is fully extended, the cord pulls the rear fabric anchor extrusion 111 downward, thereby rotating the shade canopy 102 to its horizontal default position. Also, if the front fabric anchor extrusion 110 (see FIG. 1A) is forced downward, for example as a result of an accumulation of snow on the shade canopy 102, the rear fabric anchor extrusion 111 rotates upward, thereby pulling the piston upward and energizing the gas spring such that when the downward force is removed or released, the piston extends, and the shade canopy 102 rotates to its default, horizontal orientation.

In some circumstances, maintaining the shade canopy on an increased pitch configuration is a preferred orientation, and the shade canopy may be rotated temporarily to an alternate, horizontal orientation.

Figure 7D:
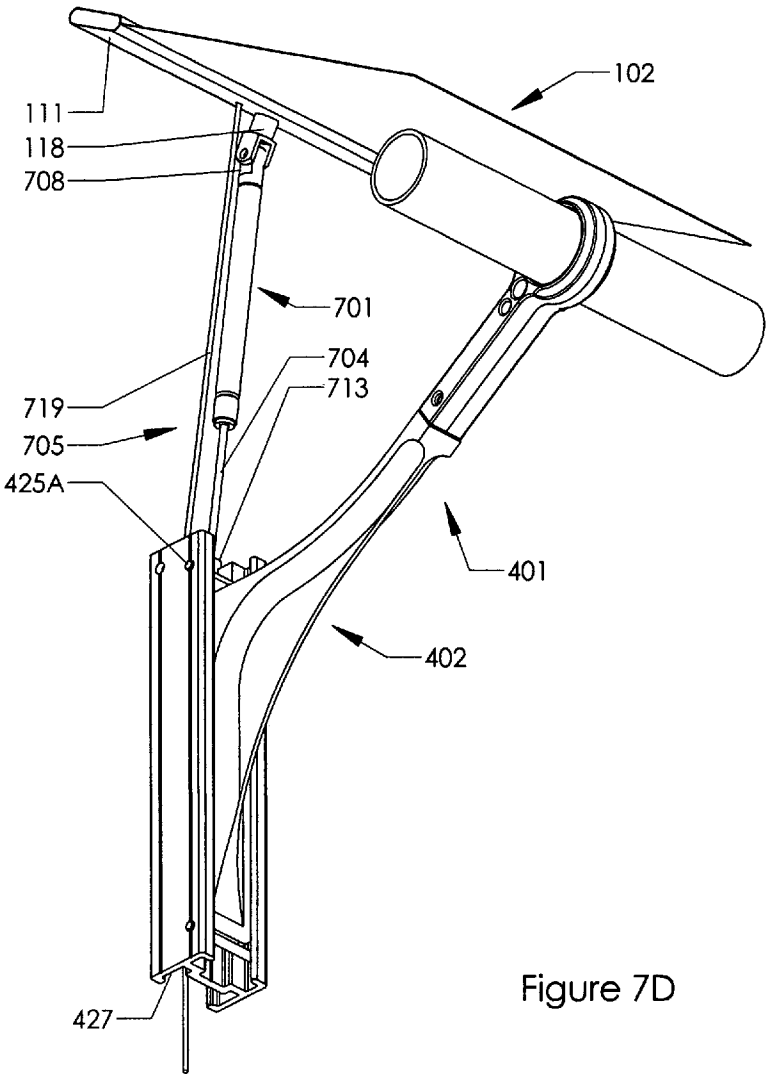
FIG. 7D illustrates a compression gas spring positioned to maintain shade canopy in a default, pitched orientation.

FIG. 7D illustrates an alternative application of a gas spring 701 to achieve maintenance of increased pitch and return to the increased pitch orientation when the shade canopy has been rotated to a temporary, horizontal orientation through pulling the pitch cable. In this configuration, the default orientation of the shade canopy 102 is in a pitched orientation with the rear fabric anchor extrusion 111 elevated, and the front fiber anchor extrusion 110 rotated downward. A compression gas spring 701 is illustrated in FIG. 7D in the default pitch orientation with the piston arm of the gas spring 701 fully extended.

The anchor eye 708 of the compression gas spring 701 is attached to a cylinder connector 718 that is attached to the second fabric anchor extrusion 111. The first flange stay pin 425A connects the piston arm connector 713 to the carrier bracket 402; the distal end of the piston arm 705 is also connected to the piston arm connector 713. A pull cable 719 is connected to the second fabric anchor extrusion 111 at an anchor point 719A and traverses the lower body chamber 427 of the carrier bracket 402. Downward pull on the pull cable 719 rotates the shade canopy 102 from its default, pitched orientation to a horizontal orientation and drives the piston 703 into the cylinder 702 thereby energizing (pressurizing) the cylinder such that when the downward force on the pull cable 719 is terminated, the action of the compression gas spring causes the shade canopy to rotate to its default, pitched orientation.

Under well recognized conditions, it is desirable to have the shade canopy rotate from its default, horizontal orientation to an increasingly pitched orientation during the day to increase shading and associated cooling, and then returning to its default, horizontal orientation.

Figure 7E:
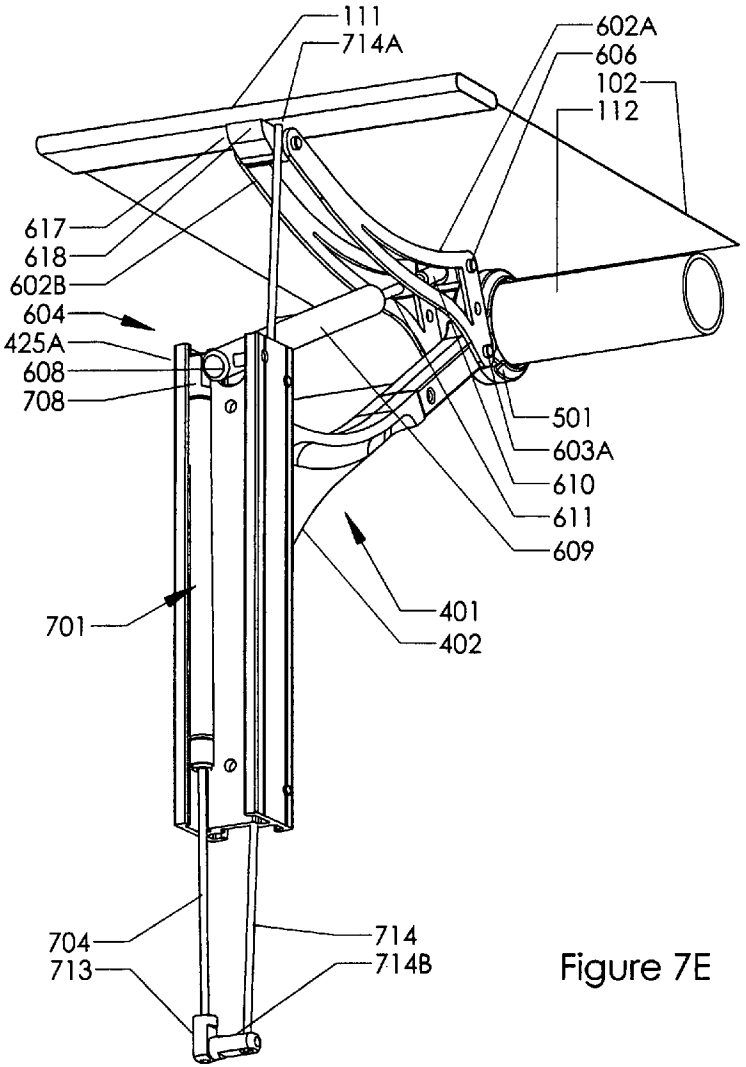
FIG. 7E illustrates positioning of both a compression gas spring positioned to maintain shade canopy in a horizontal, default orientation in conjunction with a wax piston assembly positioned to increase the pitch of the shade canopy under conditions of increasing temperature.

FIG. 7E illustrates the joint use of a wax cylinder unit 604 and a compression gas spring 701. In this figure, the shade canopy is in its default, horizontal orientation. The compression gas spring is fully decompressed with the piston 704 fully extended. The piston 611 of the wax cylinder unit 604 is fully retracted, exerting effectively no force to elevate the rear fabric anchor extrusion 111.

The upper flange stay pin 425A connects the cylinder attachment point 608 of the cylinder 609 to the mounting bracket 402. The piston 611 is threaded into the piston support block 610 that is pivotally 606 positioned between the first and second lift arms 602A and 602B, respectively. The proximal end 603A of the first and second lift arms 602A and 602B are secured to the support arm 405 at a point near the base of the axle support ring 501. The upper surface 618 of the lift arm block 617 engages the under side of the second fabric anchor extrusion 111 by direct contact.

As illustrated in FIG. 7C, the upper flange stay pin 425A also connects the compression gas spring 701 by means of the first end 714A of the connecting cable 714 to the second fabric anchor extrusion 111. The second end 714B of the connecting cable 714 is connected to the piston arm 713 by means of the cord connector 713.

Increased heat expands the wax causes the piston 611 to be forced from the cylinder of the wax cylinder unit 604. This force is transmitted through rotation of the piston support block and resulting elevation of the first and second lift arms 602A and 602B to the lift arm block 617 that in turn exerts upward pressure on the rear fabric anchor extrusion 111, pulling the connecting cable 714 upward and forcing the piston arm 704 into the piston, thereby compressing (or energizing) the compression spring 701, such that when the force from the wax piston is terminated, the compression spring decompresses, the piston is extended, and the connecting cable 714 pulled downward, returning the shade canopy 102 to its default, horizontal orientation.

The compression gas spring 701 FIG. 7A may function in connection with the wax piston assembly 601 (see FIG. 6A). In this case the force to rotate the shade canopy downward (elevate the rear the second fabric anchor extrusion 111) is generated through heat acting on the wax piston assembly 601 as previously described. When the rear fabric anchor extrusion 111 moves upward in response to force transmitted through the wax piston assembly 601, the piston connecting cable 714 pulls the piston arm 704 upward thereby driving the piston 703 upward, thereby compressing the gas in the compression chamber 707. So long as the upward force transmitted by the piston pressure assembly 601 is maintained, the shade canopy 102 remains in its rotated orientation. Only in the absence of upward force transmitted through the piston pressure assembly 601 does the compression gas spring 701 affect the orientation of the shade assembly 102. The force (energy) of the compressed gas forces the piston 703 downward; the connecting cable 714 transmits this to the rear fabric anchor extrusion causing it to be lowered from its elevated orientation, and the shade canopy 102 to rotate to its default, horizontal orientation.

Compression gas springs of different sizes (length of cylinder and arm, diameter of cylinder, and range of operating pressures is required for the three modes described above. Commercial suppliers such as International Gas Springs (see igsprings@aol.com)

It is understood that the invention in one mode may include both the wax piston assembly 601 and the compression gas spring 701; whereas, in an alternative mode, the invention may include only the compression gas spring, and in another mode, pitch control of the shade canopy may be exclusively by manual means, requiring neither the wax piston assembly nor the compression gas spring (see FIG. 8A and FIG. 8B and the accompany explanation, below.) All such variation and combinations are anticipated by the invention.

FIG. 7D illustrates the use of a single compression spring by which the shade canopy is maintained in the default orientation of increased pitch to afford maximum shading. External force is required to rotate the shade canopy to its alternate, horizontal (minimum) shade orientation.

Figure 8A:
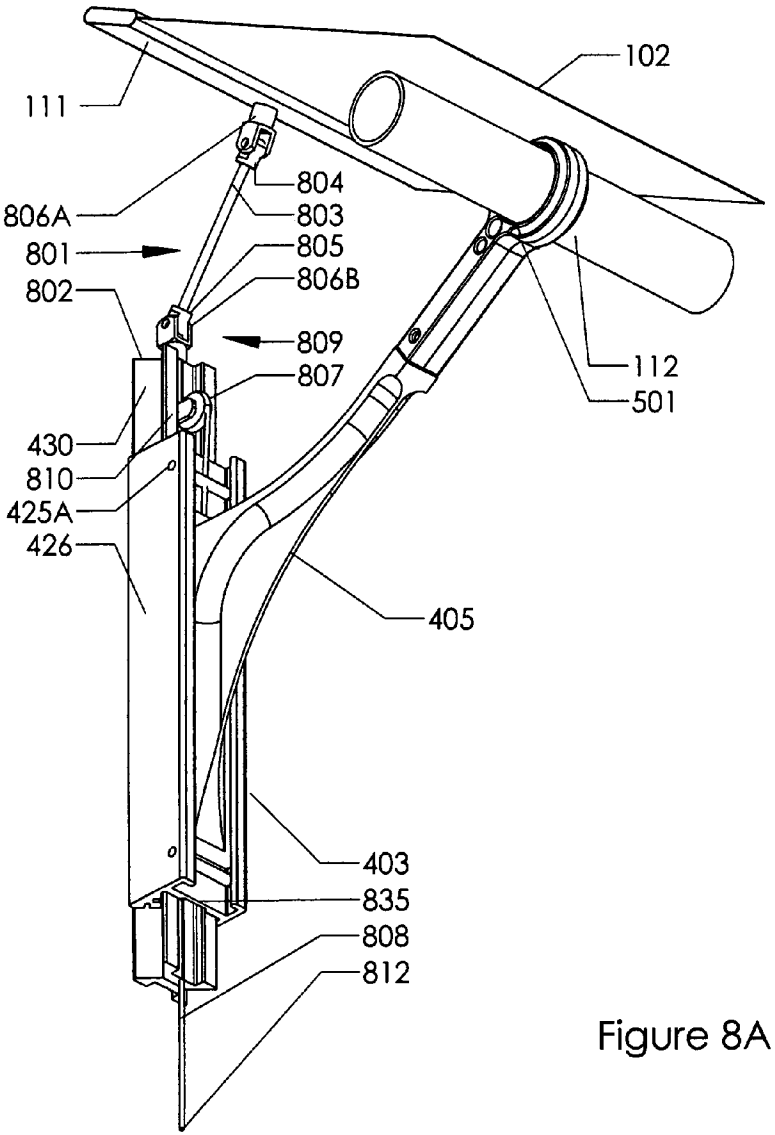
FIG. 8A illustrates a manual pitch adjustment system by which both shade canopy pitch and elevation are controlled by a pitch/elevation adjustment assembly using the modified mounting bracket.

FIG. 8A illustrates the invention in which both pitch of the shade canopy and elevation of the modified mounting bracket can be manually controlled. In this configuration, the dove-tail mounting plate 430 is secured to the building/window frame as previously described. The modified carrier bracket 426 is further adapted to include a lift cable chase 835. Details of several modifications to create the lift cable are illustrated in FIG. 8B and discussed below.

In the above configuration, the rear fabric anchor extrusion 111 is connected to the upper end 802 of the dove-tail mounting plate 430 by a pitch/elevation adjustment assembly 801. The pitch/elevation adjustment assembly 801 comprises a connecting rod 803 with a first end 804 and a second end 805. The first member 806A of a pair of clevises is connected to the first end 804 of the connecting rod 803 and is also connected to the rear fabric anchor extrusion 111, and the second member 806B of the pair of clevises is connected to the second end 805 of the connecting rod 803 and is also attached to the upper end 802 of the dove-tail mounting plate 430 thus allowing for needed angle change in the connecting rod 803.

The first end of a louver lift cable 808 is connected to the first flange stay pin 425A. The louver lift cable 808 is functionally connected to a pulley system 809 comprising a mounting bracket 810 and a wheel/axle assembly 811. The mounting bracket 810 is securely attached to the dove-tail mounting plate 430 as shown in FIG. 8A.

The louver lift cable 808 engages the pulley wheel 807 and extends downward, through the lift cable chase 835, with the free end 812 extending from the lift cable chase.

The shade canopy 102 is supported as previously described (see FIG. 1A), the base flange plate 404 is positioned as described in FIGS. 4A,B, and C, and the central axle tube 112 rotates in the axle support ring 501 in response to changing the vertical position of the dove-tail mounting plate in relation to the modified carrier bracket 426 by downward force on the louver lift cable 808, moving the modified mounting bracket 426, or by allowing the modified carrier bracket 426 to move downward by force of gravity. The rotation changes the pitch angle of the shade canopy 102 in response to the change in position of the rear fabric anchor extrusion 111 to upward/downward movement transmitted by the connecting rod 803.

The structures and functions of the vertical support arm 405 and support ring remain unchanged from previous examples.

Stabilizing the vertical position of the of the modified carrier bracket 426 and thus the pitch orientation of the shade canopy 102 is achieve simply by securing the free end 812 of the louver lift cable by any of a variety of means understood by one skilled in the art.

Figure 8B:
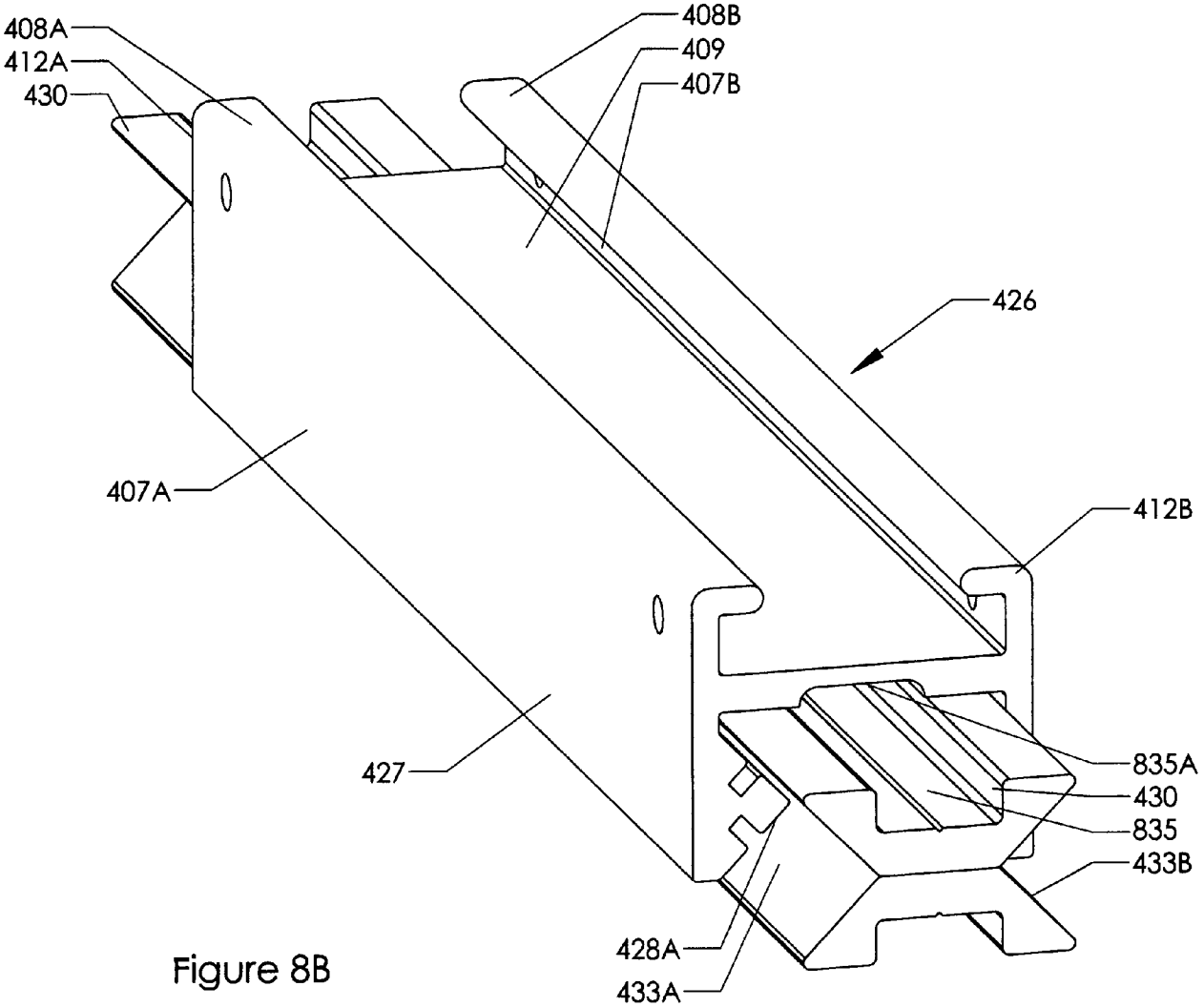
FIG. 8B illustrates alterations to the modified carrier bracket and dove-tail mounting plate to form a cable lift chase for manual pitch adjustment system.

FIG. 8B illustrates a variety of simple alterations to the modified mounting bracket 426 each of which may form a functional lift cable chase 835. Note, much of the detail of FIG. 4F is repeated in FIG. 8B to illustrate specific alterations of the modified mounting bracket 426 to form the lift cable chase 835.

The basic modified carrier bracket 426 remains unchanged. The first and second walls 407A and 407B respectively are connected by the bottom wall 409. The first and second walls 407A and 407B are divided into a first and a second upper side wall 412A and 412B and into a first and a second lower side wall 413A and 413B.

The dove-tail mounting plate 430 is positioned in the lower body chamber 427 of the modified mounting bracket 426. The first and second dove tail guides 428A and 428B, respectively, engage the first and second dove tail notch 433A and 433B.

One alternative for an effective lift cable chase 835 is a groove formed in the upper surface of the dove-tail mounting plate, extending the full length of the dove-tail mounting plate 430. A complimentary groove 835A may be manufactured in the under surface of the bottom wall 409 of the modified mounting bracket 426.

One skilled in the art recognizes a suitable lift cable chase could be formed in either of the dove-tailed guides 428A and 428B (note, in FIG. 8B only dove-tail guide 428A is shown), or in the dove-tail mounting plate 430.

Figure 9A:
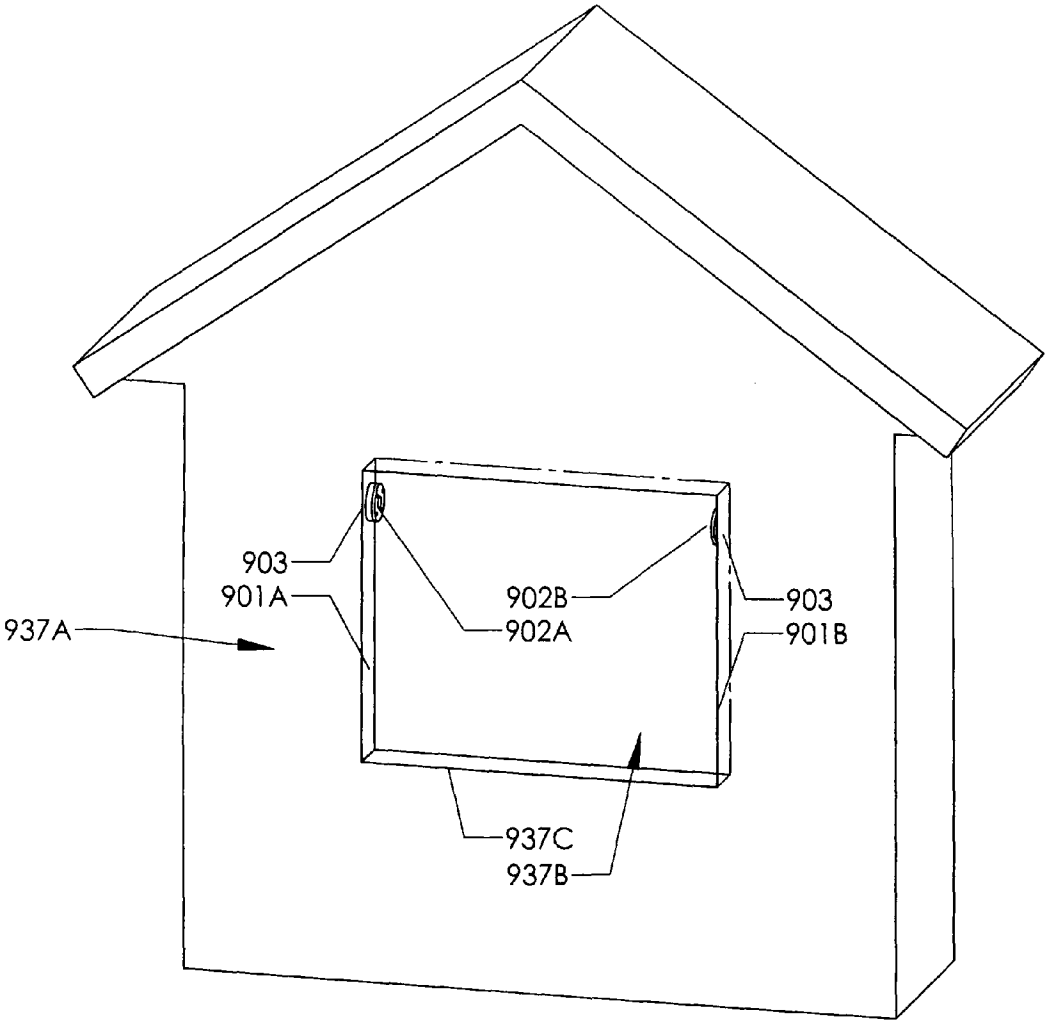
FIG. 9A illustrates an alternative method of mounting the shade louver assembly using a wall mounted axle receiver.
Figure 9B:
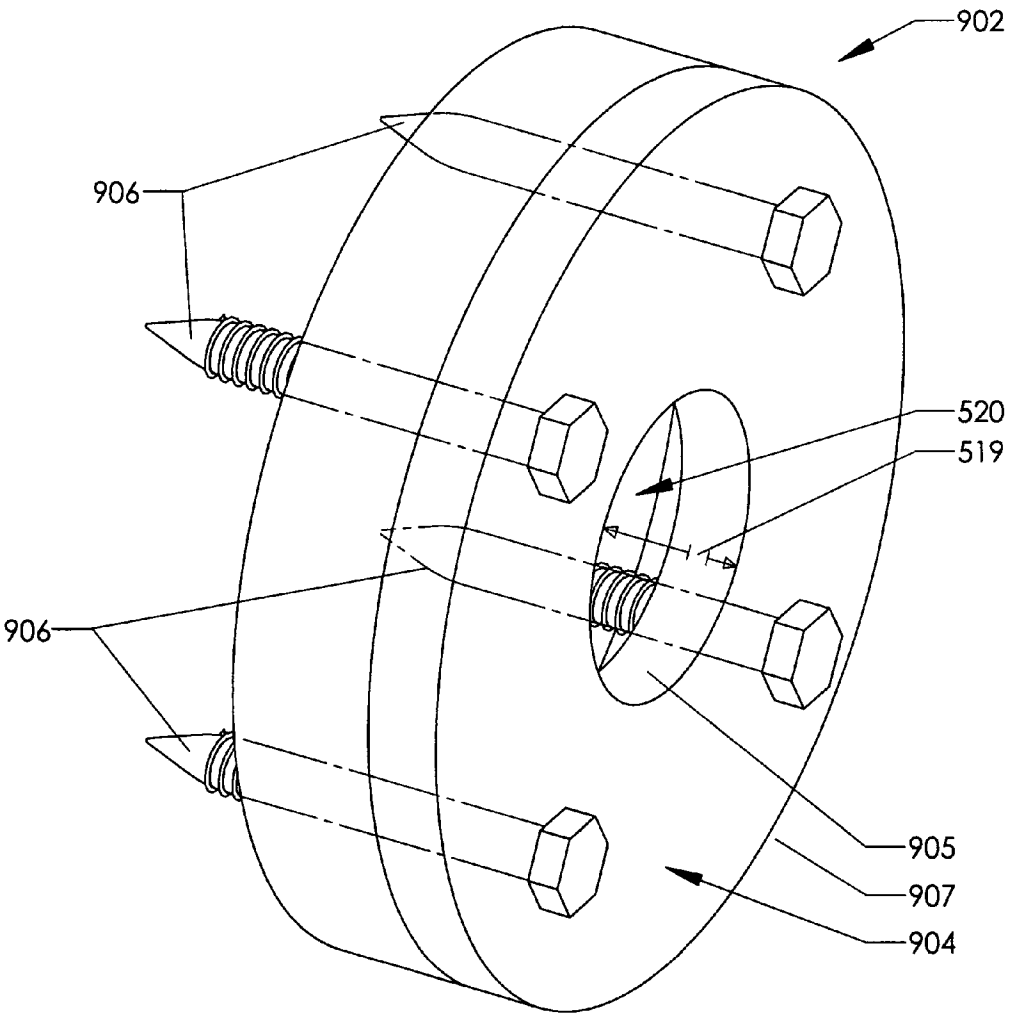
FIG. 9B illustrates details of the wall mounted axle receiver.

For most installations, the louver shade assembly 101 is mounted on and secured to the face of a building 937A with the shade canopy 102 extending over a window 937B, and the central axle tube 112 positioned below the top line 937C of the window 937B. FIG. 9A illustrates a modification to this installation secured directly on the face of a wall.

The opposing faces of a vertical wall element 901A and 901B support the entire window structure 937B and 937C (glass, actual window frame, and related structures or hardware as understood by one skilled in the art). The wall elements 901A and 901B functionally provide the full support functions of the carrier bracket assembly 401. A wall mounted axle receiver 902 comprises a modification of the axle support ring 501. The members of a pair of wall mounted axle receivers 902A and 902B are secured on opposing faces of the wall elements 901A and 901B, most commonly in a recessed chamber 903 in each wall element.

The rod rib assemblies 201 positioned at the first and second ends 116A and 116B of the central axle tube 112 are moved inward to allow the first 116A and second 116B ends of the central tube axle 112 to engage the chase lumen 520 of each corresponding wall mounted axle receiver 902A and 902B.

The wall mounted axle receiver 902 functionally replaces the support axle ring 501. The wall mounted axle receiver 902 comprises a body plate 904 with a chase lumen 520 with a diameter 519. The interior surface 905 comprises a flange or alternatively a friction-reducing coating, such as, but not limited to nylon. The first 116A and second 116B ends of the central axle tube 112 rotatably engage the corresponding chase lumen 520 of one member of the pair of wall mounted axle receivers 902A or 902B. The members of the pair of wall mounting receivers 902A and 902B are anchored to the wall element, usually in a recessed chamber 903 in each wall element 901A and 901B, thereby supporting the central axle tube 112, shade canopy 102, and rod rib assembly 201. Anchor points 905 are manufactured in the body plate 904 adapted to the use of appropriate anchoring hardware as understood by one of average skill in the art. In addition, adjustable standoff lugs 906 extend from the inner face 907 of the body plate 904 to provide adjustment for proper spacing and clearance of the shade canopy from the building structures 437A.

These and other modifications and variations of the present invention may be practiced by those of ordinary skill in the art, without departing from spirit and scope of the present invention. In addition, it should be understood that the aspects of the various embodiments may be interchanged both in whole or in part; those of ordinary skill in the art will appreciate that the foregoing descriptions are by way of example and are not intended as limitations in any way. Therefore, the spirit and scope of the appended claims should not be limited to the descriptions of the preferred versions contained therein.

I claim:

1. A louver shade assembly comprising:

a louver assembly, wherein said louver assembly comprises a shade assembly, a rotatable, central axle tube, and at least two rod rib assemblies, wherein said shade assembly comprises a fabric element, wherein said fabric element comprises a front edge and a back edge, and said shade canopy further comprises a front fabric anchor extrusion and a rear fabric anchor extrusion, wherein said front fabric anchor extrusion is physically and functionally connected to said first edge of said fabric element and said rear fabric anchor extrusion is physically and functionally connected to said rear edge of said fabric element; and further, wherein said rotatable central axle tube comprises a length, a first end and a second end, a longitudinal center line and a common diameter line; further, wherein each of said at least two rod rib assemblies comprises a rib arm unit wherein said rib arm unit comprises a long arm and a short arm, and further wherein said rib arm unit traverses said rotatable central axle tube along said common diameter line; and further, wherein said rib hub unit comprises two half sections, wherein said two half sections are securely connected by mechanical means, and further wherein said rib hub unit comprises a hub axle lumen, wherein said hub axle lumen is defined and limited by lumen walls, and wherein said rib hub unit further comprises an arm unit clamp chase with a first end and a second end; wherein, said rotatable central axle tube engages said hub axle lumen and is held frictionally tight in position by contact with said lumen walls, and wherein said arm unit clamp chase functionally engages said rib arm unit and securely clamps said long arm and said short arm in position, extending from said first and said second end said arm unit clamp chase.

2. The louver shade assembly of claim 1, wherein said louver shade assembly is positioned on a modified mounting bracket and wherein a dove-tail mounting plate is anchored to the structure to which said louver shade assembly is to be attached and further wherein wedge guides are positioned in the lower body chamber of said modified mounting bracket, functionally engaging said dove-tail mounting plate; said louver shade assembly further comprises a pitch/elevation adjustment assembly wherein said pitch/elevation adjustment assembly comprises a connecting rod with a first end and a second end, wherein said first end of said connecting rod is connected by the first member of a pair of clevises to the rear fabric anchor extrusion and said second end of said connecting rod is connected by the second member of said pair of clevises to the upper end of said dove-tail mounting plate, and further wherein said pitch/elevation adjustment assembly further comprises a pulley system wherein the wheel mounting bracket is attached to the upper end of said dove-tail mounting plate, and wherein said pulley system further comprises a lift cable, wherein one end of said lift cable is connected to said first flange stay pin and further wherein said lift cable functionally engages the wheel of said pulley system, and wherein the free end of said lift cable extends downward through and from the lift cable chase.

3. The louver shade assembly of claim 1, wherein said louver shade assembly further comprises at least two pairs of canopy tensioners, wherein, each member of said at least two pairs of canopy tensioners comprises a tensioner body, wherein said tensioner body comprises an arm connecting chase and a camber cable chase, and further, wherein said arm connecting chase of, each member of said at least two pairs of canopy tensioners is adapted to engage a threaded end of said rib arm unit, thereby connecting said canopy tensioner to one end of said rib arm unit, and further wherein the first member of each of said two pair of canopy tensioners is attached to a front fabric anchor extrusion and the second member of each at least two pair of canopy tensioners is attached to a said rear fabric anchor extrusion; and further, wherein a tension adjustment nut is positioned on and engages the threaded ends of said rib arm unit and functionally contacts the interface of the adjacent canopy tensioner body.

4. The louver shade assembly of claim 3, wherein said louver shade assembly further comprises at least two carrier bracket assemblies, wherein each of said at least two carrier bracket assemblies comprises a mounting bracket and a carrier unit, wherein said mounting bracket comprises a first and a second flange guide channels wherein said first and said second flange guide channels comprise and are defined and limited respectively by the first and second upper side walls, the first and second top walls, and the bottom wall, wherein said bottom wall extends the length of said carrier unit and connects the first and second side walls; and further, wherein a line common to said first and said second side walls said first and second side walls into first and second lower side walls and first and second upper side walls; and further, wherein each of said first and said second flange guide channels is adapted to engage and hold in a functional position a member of a pair of flange guides; and further, wherein said carrier unit comprises a base flange plate, wherein said base flange plate comprises a support arm, wherein said support arm is contiguous with said base flange plate and extends vertically upward from said base flange plate, wherein, the distal end of said support arm comprises a connector tongue; further, wherein said flange plate comprises a first flange lip and a second flange lip; further, wherein each member of said pair of flange guides comprises a guide slot, wherein said first flange lip engages and is positioned by said guide slot of said first flange guide and said second flange lip engages and is positioned by said guide of said second flange guide, thereby functionally and physically connecting said mounting bracket and said carrier unit.

5. The louver shade assembly of claim 4, wherein said louver shade assembly further comprises a camber cable system, wherein said camber cable system comprises a camber cable unit wherein said camber cable unit comprises a first end, a second end, and a length, and wherein said camber cable unit further comprises a camber cable guide, wherein said camber cable guide comprises a head and wherein said head comprises an eye; and further, wherein said camber cable unit further comprises a camber cable guide chase, wherein said camber cable guide chase traverses the bottom center of the rib hub into the hub axle lumen; and further, wherein said camber cable extends the length of the rib arm unit, is passed through said eye of said head of said camber cable guide and further wherein said first end of said camber cable is secured to the camber cable chase of the first canopy tensioner and the second end of said camber cable is secured to the camber cable chase of the second canopy tensioner; and further, wherein said camber cable guide is pressed fractionally tight into said camber cable chase guide, and the distal end of the threaded neck element of said camber cable guide is positioned in said camber cable chase, and a nut is threaded to the threaded neck element such that the first face of said nut contacts the outer surface of said rib hub, wherein rotating said nut in alternate directions moves the camber cable guide downward and upward thereby changing the tension on said camber cable as a function of the direction of rotation.

6. The louver shade assembly of claim 5 wherein the first end of the camber cable is secured directly to the camber cable chase of one member of a pair of canopy tensioners connected to a fabric anchor extrusion, and wherein the second end of said camber cable is connected to a turnbuckle connector device, wherein said turnbuckle connector device is connected to camber cable chase of the second member of said pair of canopy tensioners.

7. The louver shade assembly of claim 5, wherein said louver shade assembly further comprises at least two axle support ring elements, wherein each of said at least two axle support ring elements comprises a connector tongue chase body and a central axle tube chase support, wherein said connector tongue chase body comprises a first face wall and a second face wall, and a first side wall and a second side wall, and wherein the inner surfaces of said first and said second face walls and the inner surfaces of said first and said second side walls define and limit the connector tongue chase, wherein said connector tongue chase has a height, a width, and a length dimension, wherein said height, width, and length dimensions are nominally the same as the corresponding dimensions as the connector tongue; further, wherein said central axle tube chase support is defined by the first and second central axle tube chase support walls and the contiguous, circular support wall, and further, wherein said circular support wall is contiguous with said first and second face walls and said first and second side walls; and wherein the central axle tube chase support is defined and limited by first and second opposing faces of lumen support walls, and wherein axle tube chase support further comprises a chase lumen, wherein said chase lumen has a diameter, and further wherein said axle tube chase lumen is defined and limited by the interior surface of said lumen support walls, and said diameter of said chase lumen is nominally the same as the diameter of said rotatable central axle tube; and further, wherein a first and a second connector means traverse said first and said second face walls, and said second connector means further traverses said connector tongue; said first and said second connector means securely connect the two half sections of said axle support ring element and said second connector means further engages and secures said connector tongue in said connector tongue chase.

8. The louver shade assembly of claim 7, wherein said louver shade assembly further comprises a compression gas spring and a pull cable with a first end and a second end, wherein the cylinder of said compression gas spring is connected to said rear fabric anchor extrusion by a cylinder connector and further wherein the piston arm of said of said compression gas spring is connected by a piston arm connector to the mounting bracket by the first flange stay pin; and further wherein said first end of said pull cable is anchored to said rear fabric anchor extrusion and said second end of said pull cable extends vertically downward through and extends from the lower body chamber of said mounting bracket.

9. The louver shade assembly of claim 8, wherein said louver shade assembly further comprises a ridge tube assembly comprising a ridge tube wherein said ridge tube is positioned in and supported by ridge tube cradles, wherein said ridge tube cradles comprise a part of said rib hub, and further wherein said ridge tube extends parallel to and above said central axle tube for its full length and further wherein said ridge tube supports said fabric element, and further wherein said ridge tube and said front and rear fabric anchor extrusions comprise a tension support system of said fabric element.

10. The louver shade assembly of claim 7, wherein said louver shade assembly further comprises a compression gas spring wherein the first flange stay pin anchors the cylinder of said cylinder gas spring to the mounting bracket, and further wherein said cylinder is positioned downward in the lower body chamber of said mounting bracket, and further wherein the first end of a connector cable is secured to the rear fabric anchor extrusion and wherein a cord connector is attached to the second end of a connecting cable, and further, wherein, said cord connector is connected to the piston arm connector wherein said piston arm connector is connected to the distal end of the piston arm.

11. The louver shade assembly of claim 10, wherein said louver shade assembly further comprises a wax piston assembly, wherein said wax piston assembly a wax cylinder unit, and further wherein said first flange stay pin connects the attachment points of the wax cylinder to said mounting bracket, and further wherein the piston of said wax cylinder unit is functionally positioned in and connected to the piston support block, and said piston support block is rotatably connected to the distal ends of a pair of lift arms by connecting lugs; said distal ends of said pair of lift arms are anchored on the support arm of the carrier bracket; further, wherein the proximal ends of the members of said pair of lift arms are connected to a lift arm block, and said lift arm block functionally contacts the undersurface of the rear fabric anchor extrusion.

12. The louver shade assembly of claim 11, wherein said louver shade assembly further comprises a ridge tube assembly comprising a ridge tube wherein said ridge tube is positioned in and supported by ridge tube cradles, wherein said ridge tube cradles comprise a part of said rib hub, and further wherein said ridge tube extends parallel to and above said central axle tube for its full length and further wherein said ridge tube supports said fabric element, and further wherein said ridge tube and said front and rear fabric anchor extrusions comprise a tension support system of said fabric element.

* * * * *